US005125658A

United States Patent [19]

Francis et al.

[11] Patent Number: 5,125,658

[45] Date of Patent: Jun. 30, 1992

[54] BASEBALL BOARD GAME

[75] Inventors: Geoffrey V. Francis, Oakville; Stephen W. Pendry, Thornton, both of Canada

[73] Assignee: Vision Engineering & Design Inc., Ontario, Canada

[21] Appl. No.: 714,672

[22] Filed: Jun. 13, 1991

Related U.S. Application Data

[63] Continuation-in-part of Ser. No. 552,903, Jul. 16, 1990, abandoned.

[51] Int. Cl.[5] ..... A63F 7/06

[52] U.S. Cl. ..... 273/89; 273/90; 273/91; 273/109; 273/85 B

[58] Field of Search ..... 273/88–91, 273/26 B, 109, 118 A, 119 A; 124/78

[56] References Cited

U.S. PATENT DOCUMENTS

| | | | |
|---|---|---|---|
| 1,144,472 | 6/1915 | Harberson | 273/90 |
| 1,492,127 | 4/1924 | Fox et al. | 273/88 |
| 1,687,180 | 10/1928 | Pickett | 273/89 |
| 1,802,521 | 4/1931 | Miner | 273/88 |
| 2,016,465 | 10/1935 | Viets | 273/89 |
| 2,244,204 | 6/1941 | Kessler | 273/89 |
| 2,749,122 | 6/1956 | Barrett | 273/89 |
| 2,775,457 | 12/1956 | Galbos | 273/89 |
| 2,829,895 | 4/1958 | Moen | 273/129 R |
| 2,872,193 | 2/1959 | Hamilton | 273/119 A |
| 3,136,546 | 7/1964 | Connolly | 273/26 B |
| 3,227,452 | 1/1966 | Murphy | 273/89 |
| 3,372,933 | 3/1968 | Murzyn | 273/88 |
| 3,730,525 | 5/1973 | Maeda | 273/89 |
| 3,811,674 | 5/1974 | Trbovich et al. | 273/85 E |
| 3,854,720 | 12/1974 | Duvall | 273/89 |
| 4,179,123 | 12/1979 | Tsukuda | 273/89 |
| 4,216,961 | 8/1980 | McQuillan | 273/89 |
| 4,327,913 | 5/1982 | Bock | 273/89 |
| 4,442,823 | 4/1984 | Floyd et al. | 124/78 |
| 4,671,508 | 6/1987 | Tetreault | 273/26 B |
| 4,877,244 | 10/1989 | Burrows et al. | 273/89 |
| 4,976,434 | 12/1990 | Wikner | 273/89 |

*Primary Examiner*—William H. Grieb
*Assistant Examiner*—Steven B. Wong
*Attorney, Agent, or Firm*—Barry R. Lipsitz

[57] ABSTRACT

A simulated baseball game apparatus having an upwardly facing playing surface with a home plate thereon, a pitching mechanism that rolls the ball in the general direction of home plate and a batting mechanism. A rotatable circular plate in front of the pitching mechanism enables the direction of the rolling ball to be changed. The device for rolling the ball can be pivoted about a vertical axis in order that the player can control the initial direction of the rolling ball. The bat member has an elongate portion extending generally parallel to the playing surface and a ball striking extension that extends downwardly. The bat member can be swung about an internally movable generally vertical axis extending through one end of the elongate portion.

26 Claims, 16 Drawing Sheets

Slow Plate Speed
Medium Release

Medium Plate Speed
Fast Release

Fast Plate Speed
Slow Release

BASEBALL BOARD GAME

This application is a continuation-in-part of applicant's U.S. patent application Ser. No. 07/552,903 filed Jul. 16, 1990, now abandoned.

BACKGROUND OF THE INVENTION

This invention relates to simulated baseball game apparatus having a playing surface or board on which the game is played.

Various simulated baseball games have been developed or proposed over the years. These game devices are intended to simulate to a greater or lesser extent the well known sport of baseball which has been played for many, many years. Briefly, the game of baseball involves two teams of nine players each with the teams alternating between offensive play and defensive play. The team that is playing offense has each of its players in turn attempt to hit a ball thrown towards home plate by a pitcher on the defensive team. The offensive player attempts to hit the ball with a bat and gets three chances called "strikes" to hit a fair ball. An offensive batter will be considered "out" if the ball is caught by a defensive player after it is hit in the air. Also a batter will be considered "out" if he fails to reach first base before the hit ball is thrown to first base. Runs are scored by the batters hitting singles, doubles, triples and home runs which enable the batters to run from one base to the next and eventually to home plate.

U.S. Pat. No. 4,179,123 issued Dec. 18, 1979 to M. Tsukuda describes a baseball game board that includes a pitching mechanism and a rack and pinion batting mechanism for permitting either left-handed or right handed batting. The nature of a hit ball is indicated by the region of the outfield that is struck by the ball. A home run is indicated by hitting the ball into a central portion of the outfield where the ball can escape from the flat playing surface. The pitching mechanism is an inclined groove which slants downwardly towards home plate. The device is operated by a lever that can be controlled by a player at the edge of the board. The batting mechanism includes a horizontally extending bat member that is rotatable about a vertical axis.

Earlier U.S. Pat. No. 2,244,204 issued Jun. 3, 1941 to F. H. Kessler describes a baseball game apparatus having a pitching device, a batting device and base-running means. The pitching device has a barrel mounted for horizontal swinging movement above the playing surface. Extending into this barrel is a rod provided at one end with a plunger disk which is urged by a coil spring towards the mouth of the barrel. A ball is held within the mouth end of the barrel until the pitching device is operated. This game also has infielding and outfielding devices that can be manipulated from the sides of the game board.

Early U.S. Pat. No. 1,687,180 issued Oct. 9, 1928 to H. E. Pickett describes a baseball game board with a pitching device and a batting mechanism. The pitching device consists of an arm pivoted intermediate its ends to the board. One end of the arm is connected to an elastic band. An adjustable cam plate cooperates with this arm to determine the type and direction of the ball to be pitched.

It is an object of the present invention to provide a simulated baseball game apparatus which has features and components that make the game similar to the sport of baseball. For example, with the simulated pitching mechanism described herein, it is possible for a player to produce quite a variety of "pitches", including curve balls and fast balls.

It is a further object of the present invention to provide a simulated baseball game apparatus that while being very interesting and fun to play, can still be manufactured at a reasonable cost and without undue difficulty.

SUMMARY OF THE INVENTION

According to one aspect of the invention, there is provided a simulated baseball game apparatus having an upwardly facing playing surface, a home plate on this surface, and a simulated pitching mechanism. This mechanism comprises means for rolling a ball in the general direction of home plate and manually operated means for changing the direction of the rolling ball after it leaves the rolling means. The direction changing means includes a rotatable plate having a generally flat upper surface located in the plane of the playing surface. The direction changing means is separate from the rolling means and at least a portion of the rotatable plate extends forwardly from a release point for the rolling means in the direction of the home plate.

Preferably, the pitching mechanism includes means for pivoting the rolling means about a vertical axis in order that a player of the game can control the initial direction of the rolling ball.

According to another aspect of the invention, a simulated baseball game apparatus having a generally flat, upwardly facing playing surface and a home plate includes a batting mechanism mounted in the apparatus adjacent home plate. This mechanism includes a top member having an elongate bat portion extending generally parallel to and above said playing surface and a vertically extending stem rigidly connected to one end of said bat portion, and a bottom member having means for pivotally mounting a lower portion of said stem so that said stem is free to pivot about a substantially vertical axis, said bottom member including an arm portion providing manual means for moving said bottom member in a direction generally parallel to said playing surface.

According to a further aspect of the invention there is provided in a simulated baseball game apparatus having a generally flat, upwardly facing playing surface and a home plate, a batting mechanism movably mounted in said apparatus adjacent said home plate, said mechanism including an elongate bat portion having a ball-striking end portion and an opposite end portion and being located above said playing surface; a vertically extending stem portion connected to said opposite end portion and capable of pivoting with said bat portion about a generally vertical axis; and a bottom member for pivotally supporting said stem portion, said bottom member including means for manipulating same in order to move said bottom member, said stem portion and said bat portion in a direction generally parallel to said playing surface.

According to still another aspect of the invention, a simulated baseball game apparatus has a playing surface and a fielding device movably mounted on the playing surface, said device including means for catching and sending a ball comprising a pivot member defining a pivot axis extending substantially perpendicular to said playing surface and two, outwardly diverging, elongate arms extending parallel to said playing surface and connected to said pivot member so as to pivot about said pivot axis, and means for moving and pivoting said pivot member and said arms whereby they can be moved a limited distance across the playing surface and pivoted so that a selected one of the arms sends the ball to a selected location on the playing surface.

Further features and advantages will become apparent from the following detailed description when taken in conjunction with the accompanying drawings.

DETAILED DESCRIPTION OF PREFERRED EMBODIMENTS

Figure 1:
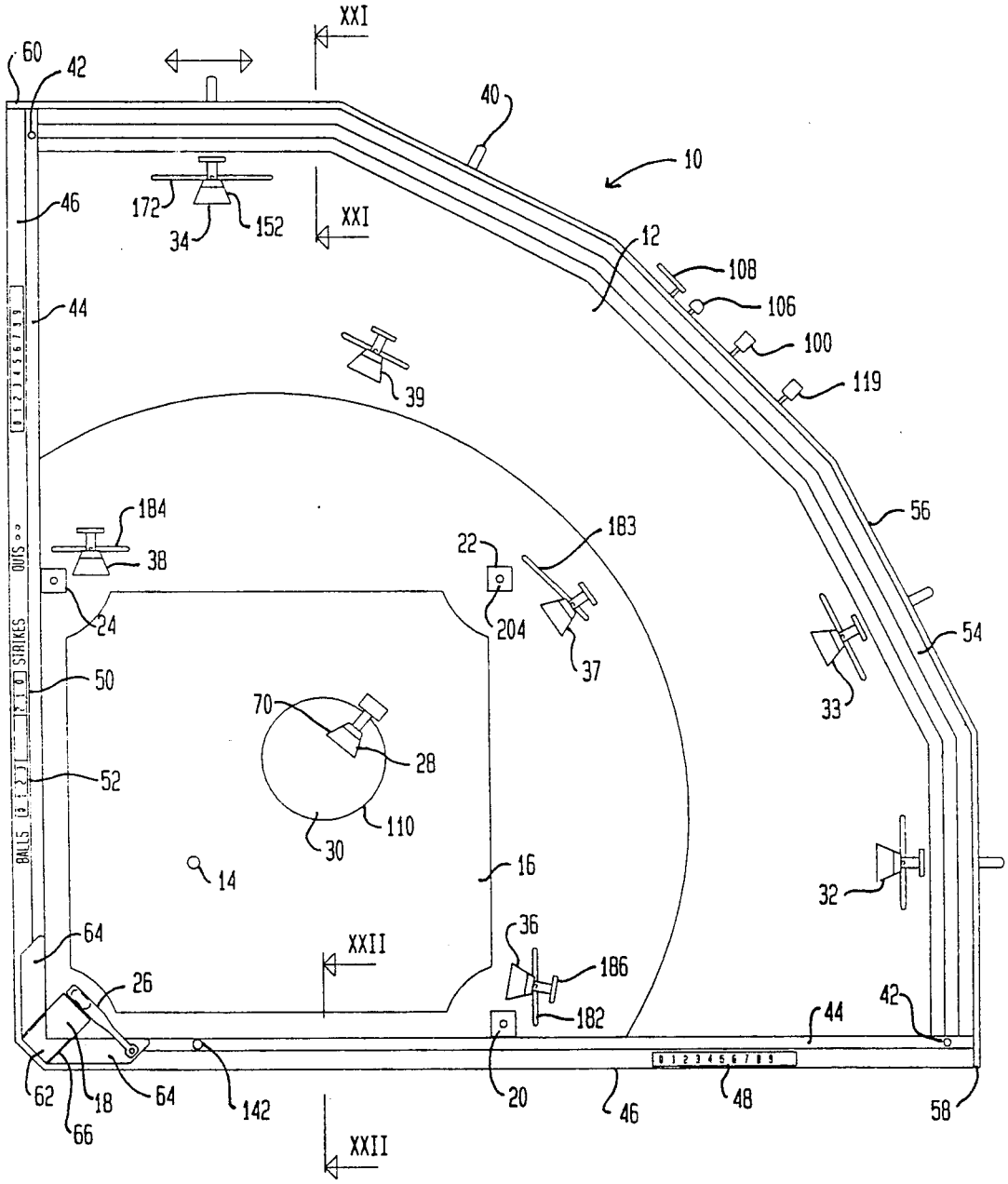
FIG. 1 is a plan view of a first embodiment of a simulated baseball game apparatus constructed in accordance with the present invention.
Figure 2:
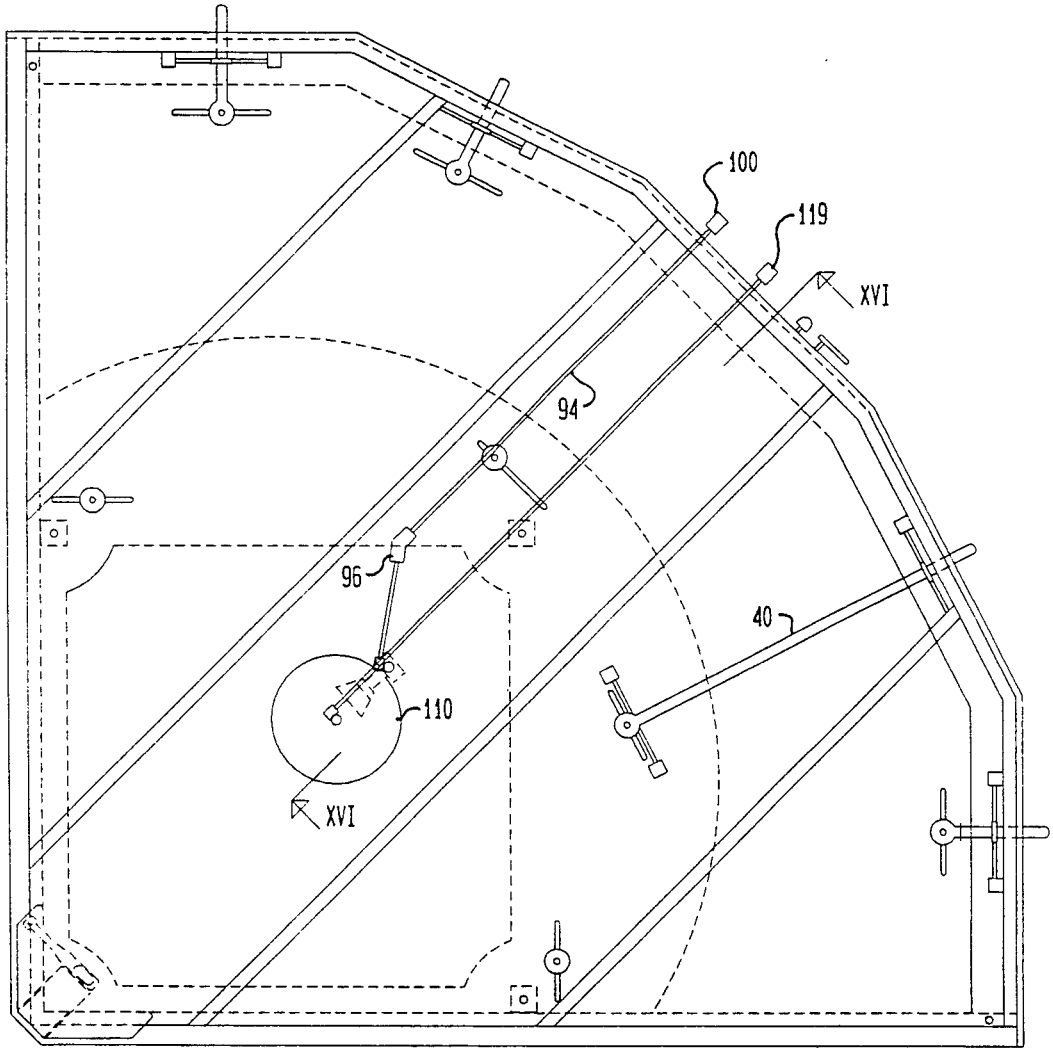
FIG. 2 is a bottom view of the game apparatus of FIG. 1.

FIGS. 1 and 2 of the drawings illustrate the top and bottom of a first embodiment of a simulated baseball game apparatus 10 constructed in accordance with the invention. This apparatus has a playing surface 12 which faces upwardly during play of a game in order that a ball 14 can be rolled across the surface. The playing surface is formed on a generally flat panel. On the playing surface there is outlined an infield 16, the four corners of which are a home plate 18, a first base 20, a second base 22 and a third base 24, similar to the usual infield for the sport of baseball. Located adjacent to the home plate 18 is a batting device 26 to be described in detail hereinafter. This device includes a bat member which is used by a player to strike a ball rolling across or in the direction of home plate.

Located close to the center of the infield is a simulated pitching mechanism indicated generally by 28. This mechanism includes means for rolling the ball 14 in the general direction of home plate. In a preferred version of the present game apparatus, there are also means for changing the direction of the rolling ball after it leaves the ball rolling mechanism and imparting a spin on the ball, these means being indicated generally at 30. The pitching mechanism will be described in greater detail hereinafter with reference to FIGS. 13 and 14.

In a normal game of baseball there are three outfield players who try to catch flyballs that are hit to the outfield and who return balls hit to their area of the outfield to the infield or home plate. In order to simulate these three outfielders, there are three fielding devices 32, 33, and 34 movably mounted on the playing surface 12. In the illustrated version of the game apparatus, the device 32 is located in right field, the device 34 is located in left field while the device 33 is located between these two devices. The device 33 is preferably located to the right of the center of the outfield in order not to interfere with the control rods that operate the pitching mechanism as described hereinafter.

Also in the sport of baseball there are four infielders, not including the pitcher, these being the first baseman, the second baseman, the third baseman and a shortstop who generally positions himself a short distance outside of a straight line joining second and third bases. In order to simulate these four infielders, there are four additional fielding devices 36–39, movably mounted on the playing surface close to or on the infield 16. The fielding devices 36–38 representing the first, second and third basemen are each constructed in substantially the same manner and they are moved manually by the defensive player or team. Generally, these three fielding devices would be positioned by the defensive player prior to the ball being pitched and they are not moved until and unless a batted ball is caught in or touches one of them. The fielding device 39 that represents the shortstop is similar in its construction except that it can be moved by means of a control handle 40. It is expected that after a ball is struck by a batter, a defensive player may move the fielding device 39 to some extent if the ball is hit in the direction of the device 39. Because the device 39 is moveable to some extent as the ball is being hit, there is an increased chance of catching the ball with the fielding device 39.

Figure 22:
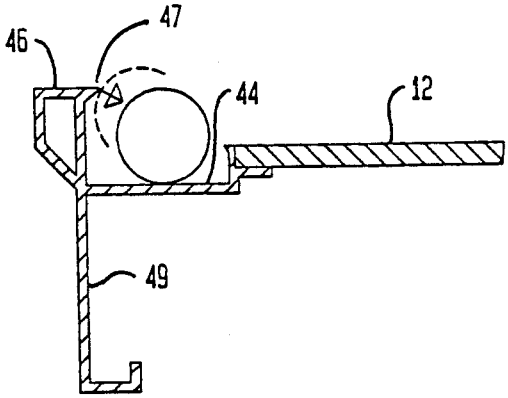
FIG. 22 is a cross-sectional elevation taken along the line XXII—XXII of FIG. 1 illustrating the construction of the edge of the board along left and right foul lines.

Other preferred features of the game apparatus 10 shown in FIG. 1 include simulated foul poles 42 located at the left field and right field corners and elongate foul gutters 44 which extend along the edges of the playing surface that extend out from home plate 18. The poles can be made detachable for storage purposes if desired. The purpose of the gutters 44 is to catch any ball 14 that is "hit" foul, preventing the ball from rolling back onto the playing surface. Located immediately out from the gutter 44 is an upstanding wall or edge member 46 which also helps to prevent balls from rolling off of the game board and onto the adjacent floor. This edge member can be provided with an inwardly protruding lip 47 as illustrated in FIG. 22 to direct balls into the gutter 44. The edge member 46, the gutter 44 and a downwardly extending leg or wall 49 can all be made from a single elongate plastic extrusion glued or otherwise attached to the flat board or panel that forms the playing surface 12. If desired, a score keeping device 48 can be positioned along the top of each wall 46. There can also be indicia 50 and 52 for keeping track of the number of balls and strikes against the batter. Extending along the outer edge of the outfield is a colored band 54 which simulates the warning track of a baseball field. An outfield fence or wall 56 may extend from the right field corner 58 to the left field corner 60 and prevents at least most balls from rolling off the playing surface at the outer edge. This wall 56 can be made sufficiently low or can be constructed in such a manner that at least some hit balls are permitted to roll over or jump the wall, such balls constituting "home runs".

Also shown in FIG. 1 are three pockets or recesses in the vicinity of home plate 18. There is a pocket 62 immediately behind the home plate 18 called the strike pocket into which a ball 14 that passes over the home plate will fall if it is not struck by the batting device. Thus, if the ball falls into this pocket, the players know that the ball was a strike to be counted against the batter. Located on opposite sides of the pocket 62 are two further, larger ball pockets 64 that extend in the direction of the left field and right field lines. If a ball 14 drops into one of these two pockets after being pitched and the player does not swing the bat, it is considered a "ball". Similar to the aforementioned gutter 44, the strike and ball pockets can have an inwardly protruding lip 65 (See FIG. 5) to direct and retain the ball in the pocket. As in the real game of baseball, if a batter received four balls, he is permitted to walk to first base. The strike pocket 62 is separated from the ball pockets 64 by means of two dividers 66 that are in line with the right and left sides of home plate.

The construction of one form of simulated pitching mechanism 28, that is partly electrical, will now be described with reference to FIGS. 1, 2, 15 and 16. The mechanism 28 includes means for rolling a ball 14 in the general direction of home plate. In order to roll the ball, it is placed in a pitching container 70 which, as illustrated in FIG. 16 has an open front 72, a rear wall 73 and a bottom 74. The container also comprises two opposing side walls 76 between which the rear wall extends. The illustrated container also includes a sloping top 77 on which may be mounted a figurine representing a pitcher (optional). Mounted on the rear wall 73 is an electrically operated release mechanism 80 in the form of an electromagnetic activator. The activator is mounted in a tube or housing 82 in which is mounted an electromagnet 83. Projecting from the interior of this electromagnet is a ball pusher 84 which extends through an opening in the rear wall.

There are means for pivoting the ball rolling device about a vertical axis in order that a player of the game can control the initial direction of the rolling ball. The pivoting device includes vertical shaft 86 which extends through a hole in the playing surface and which preferably is hollow to accommodate electrical wiring to operate the electromagnet 83. The top of shaft 86 is connected to the housing 82 which in turns supports the aforementioned container 70. Mounted on the bottom end of the shaft is a small plastic gear 88 which engages a further plastic gear 90 that is rotatable about a horizontal axis. These gears have their teeth running at a 45 degree angle and provide a 1:1 ratio between rotations. The gear 90 is operated by shafts or rods 92 and 94 which are operatively connected at their adjacent ends by a flexible connector in the form of coil spring 96. It will be understood that these shafts are rotatably supported by suitable brackets (not shown) and by a side 98 of the game board which has an opening through which the shaft 94 extends. These rods and gears turn the ball roller on a 1:1 ratio. A suitable knob 100 can be placed on the outer end of shaft 94 to make the shaft easier to rotate. Although two separate shaft members 92 and 94 are shown and are provided in order to accommodate a further control shaft used to operate the rotatable plate of the direction changer, it will be understood that a single shaft member can also be used to operate the gears 88 and 90. Also, instead of small gears 88 and 90, one can employ in a known manner a coil spring that is turned through 90 degrees and is connected to the control rod 92.

Figure 15:
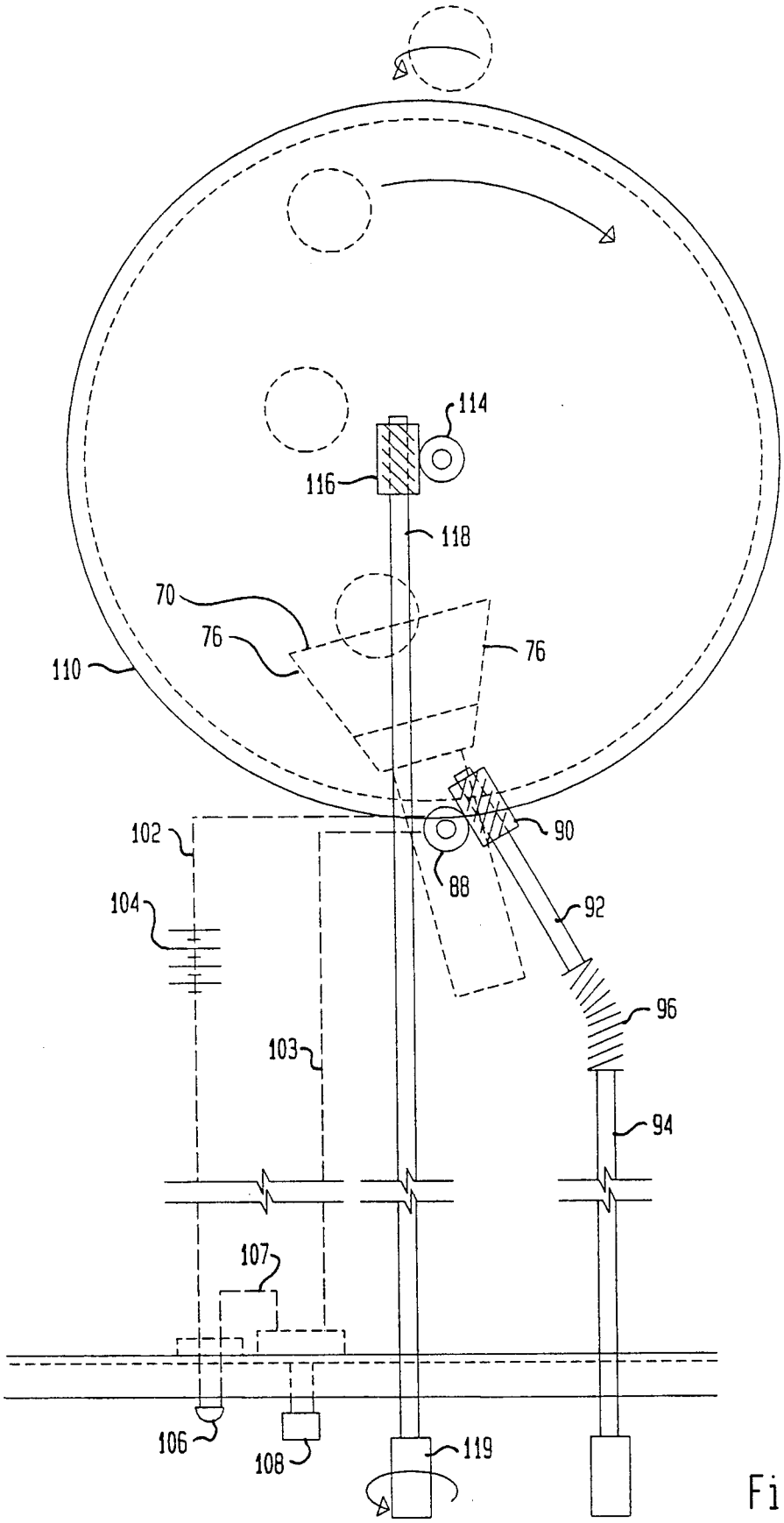
FIG. 15 is a bottom view illustrating details of one form of simulated pitching mechanism for the game.
Figure 16:
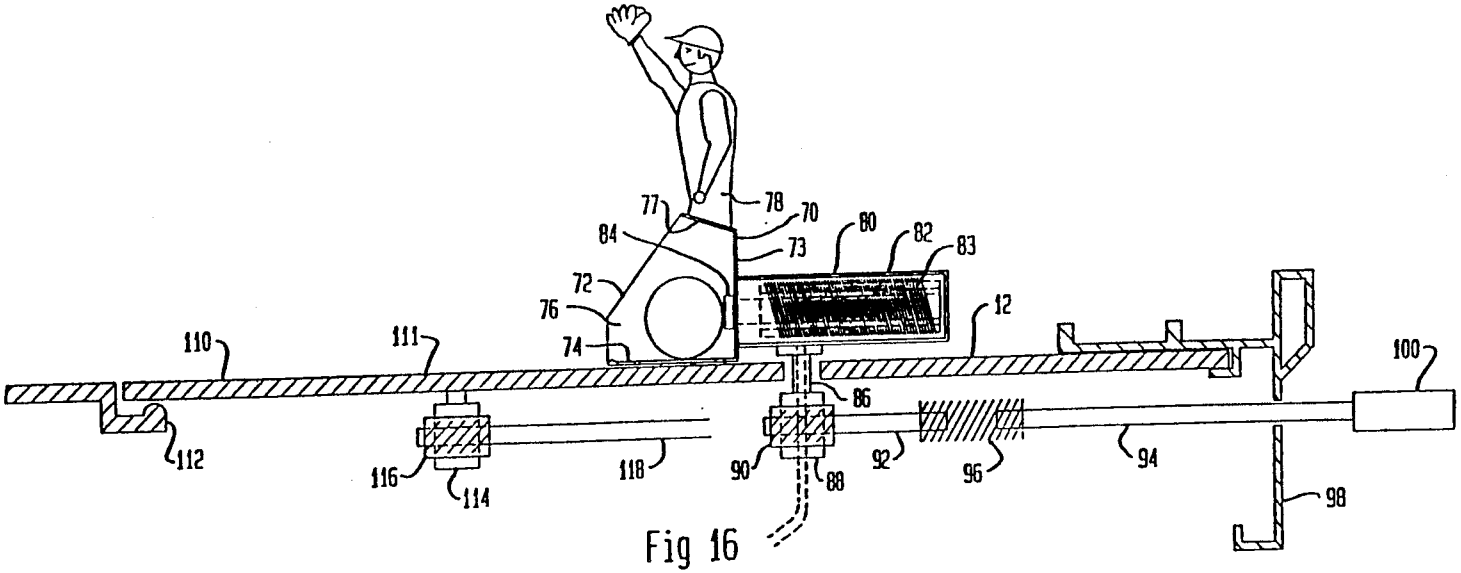
FIG. 16 is a side elevation in cross-section of the pitching mechanism of FIG. 15.

Turning now to the electrical circuit connected to the electromagnet 83 and illustrated in FIG. 15, the circuit includes two electrical wires 102 and 103 which extend through the shaft 86 to the electromagnet. The wire 102 is connected to a source of power, which in the illustrated version is a suitable battery or batteries 104. In one preferred embodiment, the power source comprises four C type 1 $\frac{1}{4}$ volt batteries. A further electrical wire connects the battery to a relay activated push button switch 106 which acts as a pitch release. The switch 106 is connected by a further wire 107 to a rheostat 108 which provides means for controlling the speed of the rolling ball. The wire 103 is connected to the rheostat 108. By proper use of the rheostat 108, the player operating the pitching mechanism can cause the ball to roll quickly (representing a fast ball) or more slowly, representing some form of breaking ball. The rheostat 108 is dialed up before the pitch is released.

The aforementioned direction changing means includes a circular, rotatable plate 110 having a generally flat upper surface 111 located in the plane of the playing surface 12. Typically, this plate is about 5 inches in diameter. As indicated, the ball rolling mechanism is separate from the direction changing mechanism so that rotation of the plate does not affect the position of the container 70, for instance. The plate 110 is rotatably supported on a fixed bearing 112 that is connected to the flat board forming the playing surface 12. The plate 110, as illustrated, has a substantial portion thereof extending forwardly from a release point for the rolling mechanism in the direction of home plate. The plate 110 has its top surface painted with a high friction rubberized paint. There are means for rotating the plate 110 operable from a location at one edge of the playing surface of the apparatus. These rotating means may include a plastic gear 114 connected by a shaft to the center of the plate and a second plastic gear 116 which rotates about a horizontal axis and engages the gear 114. These gears also have teeth running at a 45 degree angle and providing a 1:1 ratio between the rotations. The gear 116 is rotated by rotating a long control rod 118 between thumb and forefinger using the end piece 119. Instead of these gears, one can use a flexible coil spring which is turned through 90 degrees and is connected to the end of the control rod 118. With this mechanism it is possible to curve the ball up to two inches over a 17" path.

Figure 5:
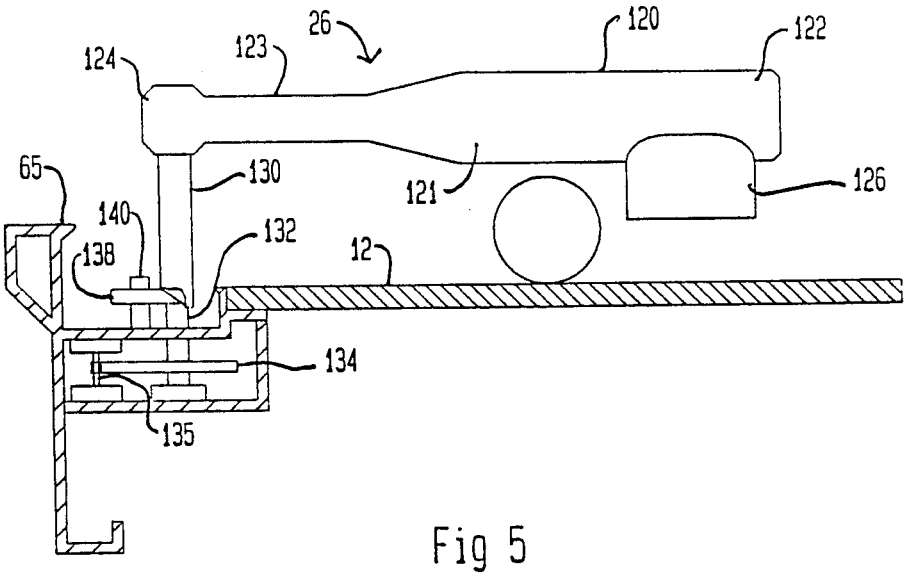
FIG. 5 is a cross-sectional elevation of one form of batting device including the bat member.

One form of batting device 26 will now be described with particular reference to FIGS. 5–8 of the drawings. This device which is located adjacent home plate 18 includes a bat member 120 having an elongate portion 121 that extends generally parallel to and above the playing surface 12 as illustrated in FIG. 5. If desired, this elongate portion can be shaped in the manner of a standard bat with a relatively wide barrel at 122, a narrower handle 123 and a knob 124 at one end. The bat member has a ball striking extension 126 rigidly mounted on the elongate portion and extending downwardly therefrom. The illustrated extension has rounded end portions 127 so that a ball will be struck in various directions depending on where the ball hits the extension. It will be further noted that the elongate portion of the bat member is located a sufficient distance above the playing surface 12 that unless the ball strikes the downward extension 126, it will pass right under the bat member and drop either into a ball pocket or the strike pocket. The downward extension 126 is of a length such that it will contact the ball but will pass over the back of the ball pocket. Although the downward extension 126 can be varied in width for different skill levels, preferably its width in the longitudinal direction of the bat member is equal to or less than the width of the home plate 18. Furthermore, it will be understood that the extension 126 is so positioned that when the bat is swung, the extension 126 will pass directly over home plate. In this way, a ball that is not directed by the pitcher over home plate so that it constitutes a strike will generally not be hittable by the batter and will be considered a "ball" unless the bat member has been swung.

There are spring means for pivoting the bat member in a forwards direction from a release position. A normal swing requires the player to rotate the bat approximately 150 degrees to 220 degrees from the home plate area while a "bunt" will typically require a swing of approximately 50 degrees. In the preferred embodiment, there are means for pivotally mounting the bat member and swinging same from either the left or the right of home plate. Extending downwardly at 90 degrees from the inner end of the bat member is metal pivot tube 130 into which extends a vertical pivot pin 132. Connected to the pivot pin below the playing surface is a weak coil spring 134 which is engaged when the bat is pulled back about 45 degrees. This engagement is provided by shaping or cutting the bottom end of the tube 130 so that there will only be positive engagement with a lateral arm 138, which extends outwardly from the pin 132, when the bat member is rotated about 45 degrees. This arrangement ensures that the bat member must be pulled back and not simply left over home plate to intercept the ball. Further the bat member is rotating freely when it hits the ball, thus providing a better simulation of a natural swing. An outer end of the spring is connected to adjustable slide member 135 which extends through an elongate slot 136 formed in the bottom of the ball pocket. The adjustable member 135 provides one mechanism for preadjusting the speed of the swing. Extending upwardly from the bottom of the ball pocket is a stop member 140 which contains the spring action by preventing the movement of the arm 138 beyond the position shown in FIG. 8. It will be noted that there are further stop members 142 located a short distance along the right and left field gutters. These rubber stop members prevent the bat from being pulled back too far and also prevent the bat from spinning after it has been released and has passed through the home plate area.

Figure 6:
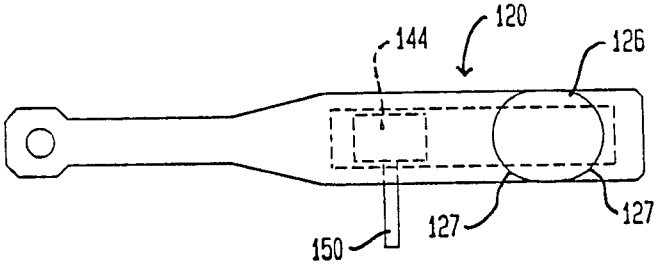
FIG. 6 is a top view of one form of bat member containing an adjustable weight.
Figure 7:
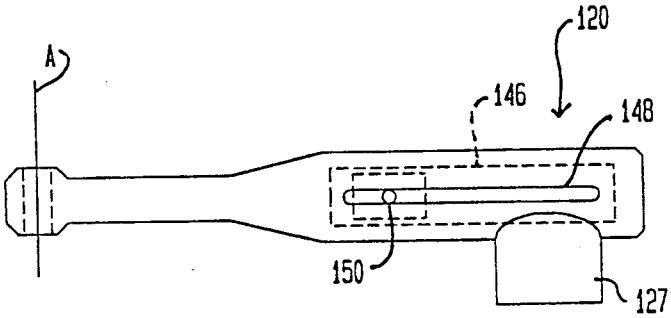
FIG. 7 is a front view of the bat member of FIG. 4.
Figure 8:
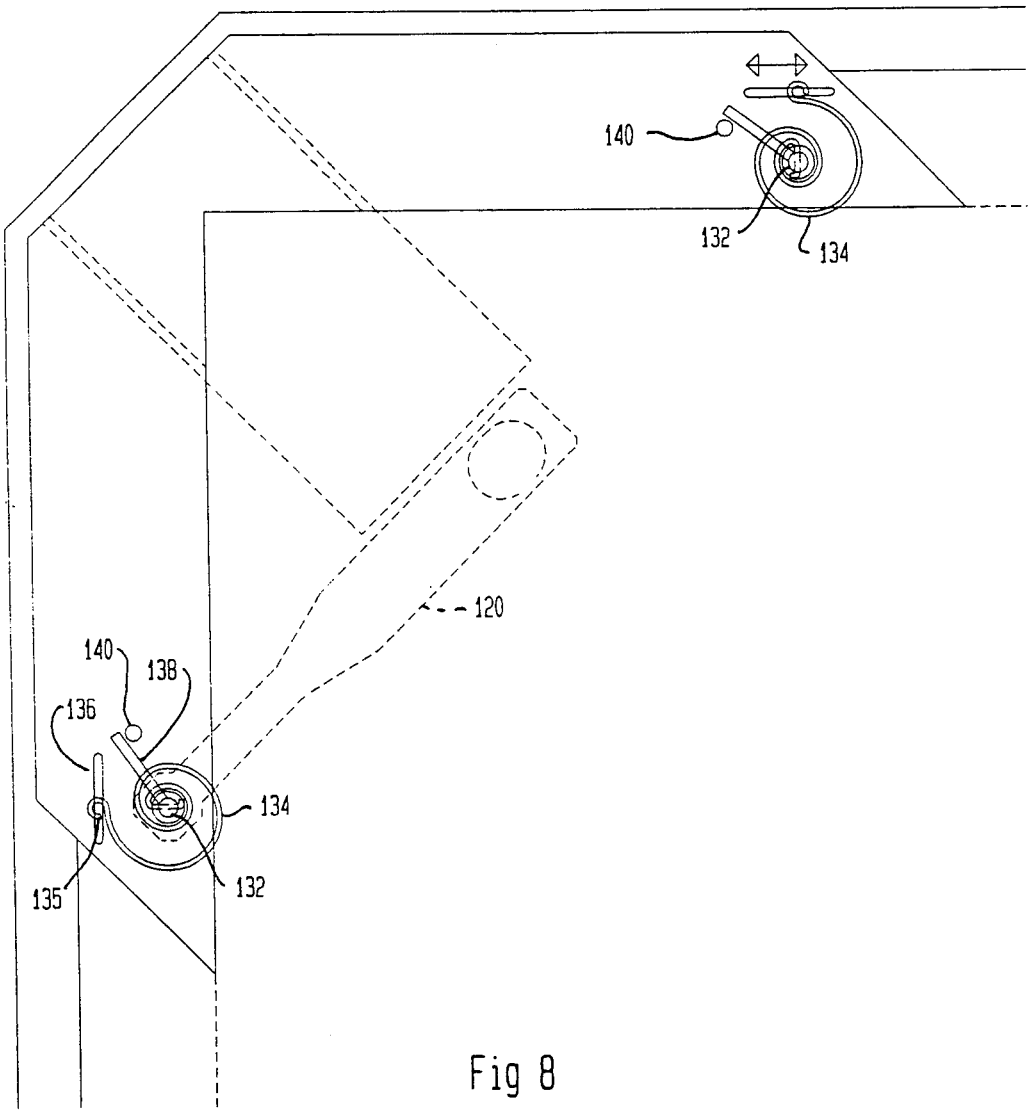
FIG. 8 is a bottom view of the home plate corner of the game apparatus of FIG. 1 with portions broken away in order to illustrate the mechanism for swinging the bat member.

An optional feature for the bat member is a movable lead weight 144 illustrated in FIGS. 6 and 7 of the drawings. The elongate portion of the bat has a longitudinal passageway 146 in which the weight is slidable. On the rear side of the bat member is an elongate slot 148 from which projects a small handle 150 used to position the weight in the bat. The weight 144 can be used to change the center of gravity of the bat and thereby the speed of the bat swing. It will be noted that the weight is slidable towards or away from the vertical axis A (about which the bat swings) in order to vary the speed of the bat. By placing the slot in the rear of the bat, the player operating the pitching mechanism cannot see the selection.

In order to change from left handed batting to right handed batting or vice versa, it is simply necessary to lift off the bat member which includes the sleeve 130 and place the member on the other pivot pin 132. Because the bat member can be easily removed and reattached, it is possible to have more than one bat member for the game if desired. For example, for a younger player, a larger "softball" bat can be provided which makes it easier for a younger player to hit the ball.

Figure 3:
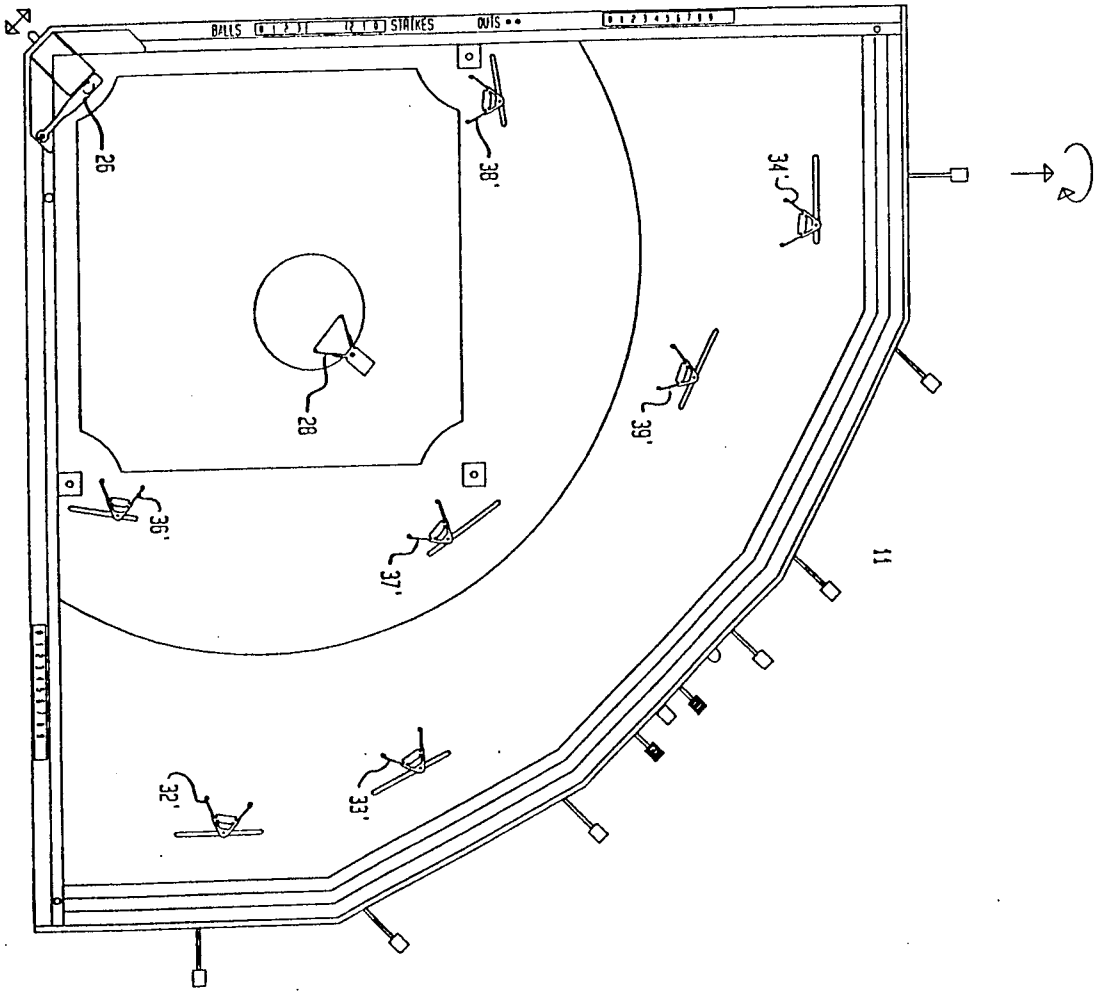
FIG. 3 is a plan view of a second embodiment of a simulated game apparatus constructed in accordance with the invention.
Figure 4:
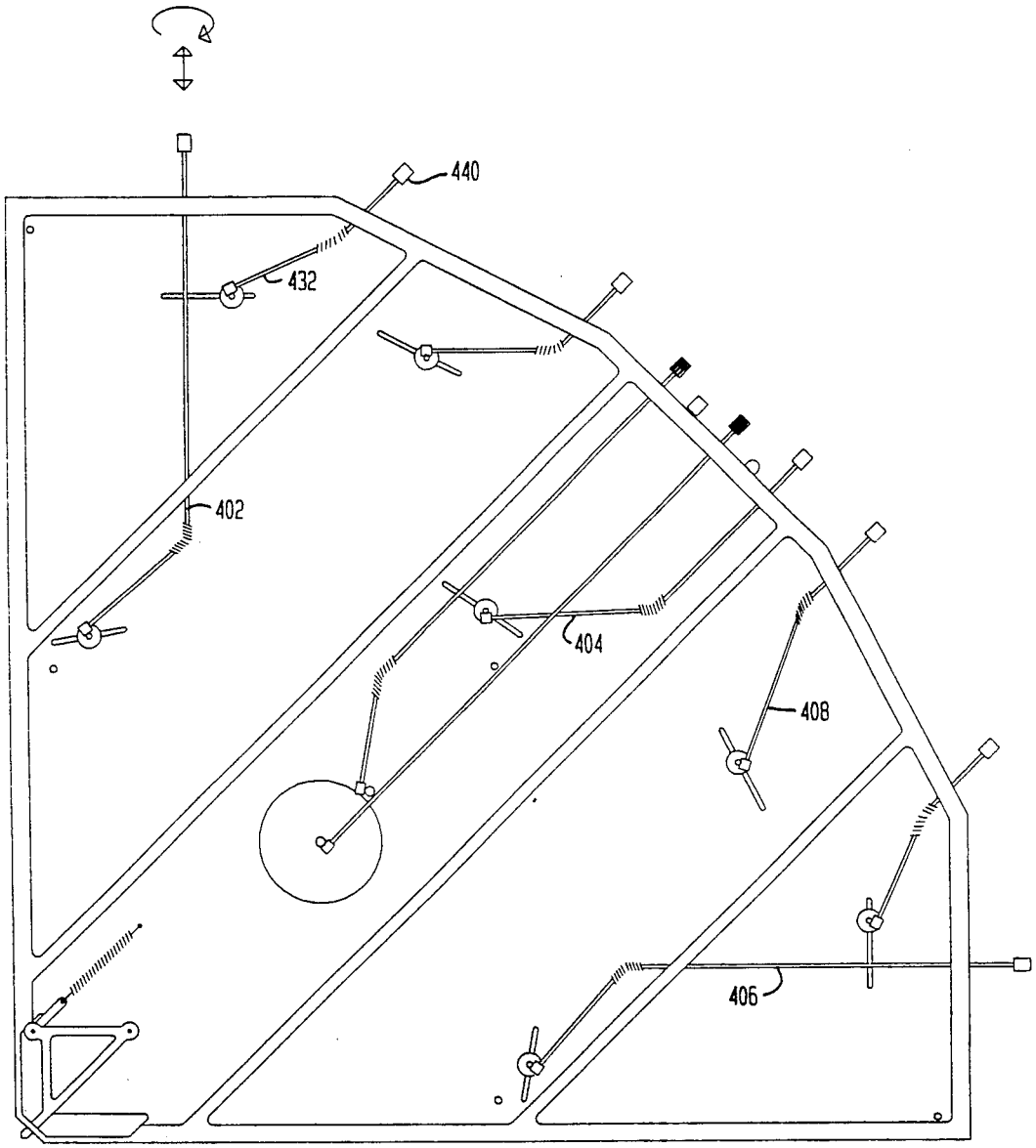
FIG. 4 is a bottom view of the game apparatus of FIG. 3.

A second embodiment of the invention is shown in FIGS. 3 and 4 of the drawings and is indicated generally by reference 11. In this embodiment the simulated pitching mechanism 28 and the batting device 26 are the same as in the embodiment of FIG. 1 and 2. However the design of the infielders 36', 37' and 38' and the design of the three outfielders 32', 33' and 34' is changed somewhat as is the design of the shortstop fielding device 39'. In this version the four fielding devices 36' to 39' are movably mounted on the playing surface and they are each constructed in substantially the same manner. Each is movable by means of a control rod mechanism shown in FIG. 4 and identified by references 402, 404, 406 and 408. These fielding devices are movable by the defensive player as desired after the ball has been pitched It will be appreciated that with the embodiment of FIGS. 3 and 4, there is an increased likelihood of the ball being caught by the infield as compared to the version of FIG. 1 and 2. The three outfielders are constructed in essentially the same manner as the infielders in this version of the game and the construction of these fielding devices will be described in detail hereinafter with reference to FIGS. 25 and 26.

Figure 9:
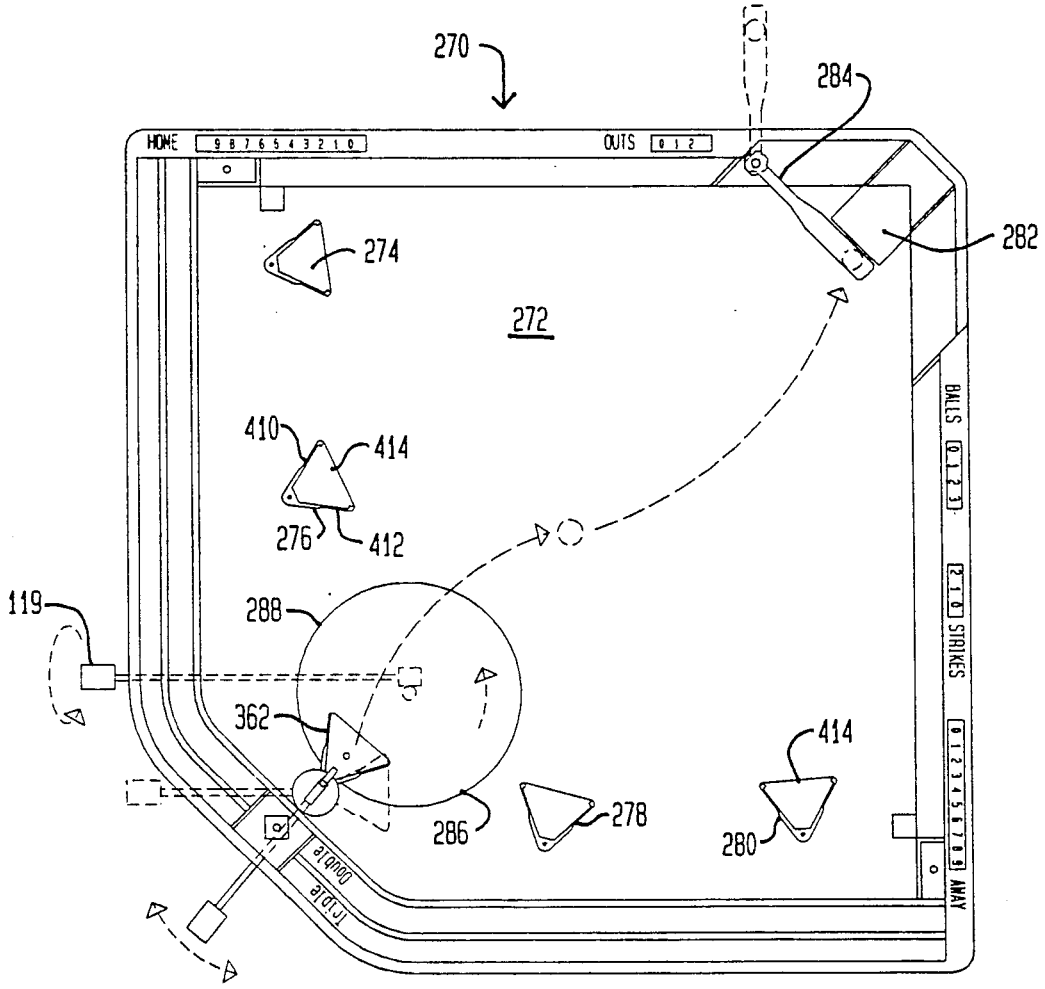
FIG. 9 is a plan view of a third smaller embodiment of a simulated baseball game apparatus constructed in accordance with the present invention.
Figure 10:
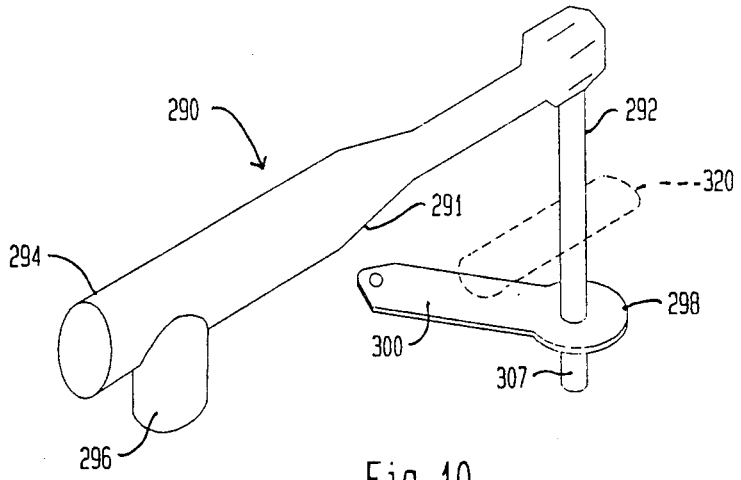
FIG. 10 is a perspective view of a top member forming part of a second form of batting mechanism.
Figure 11:
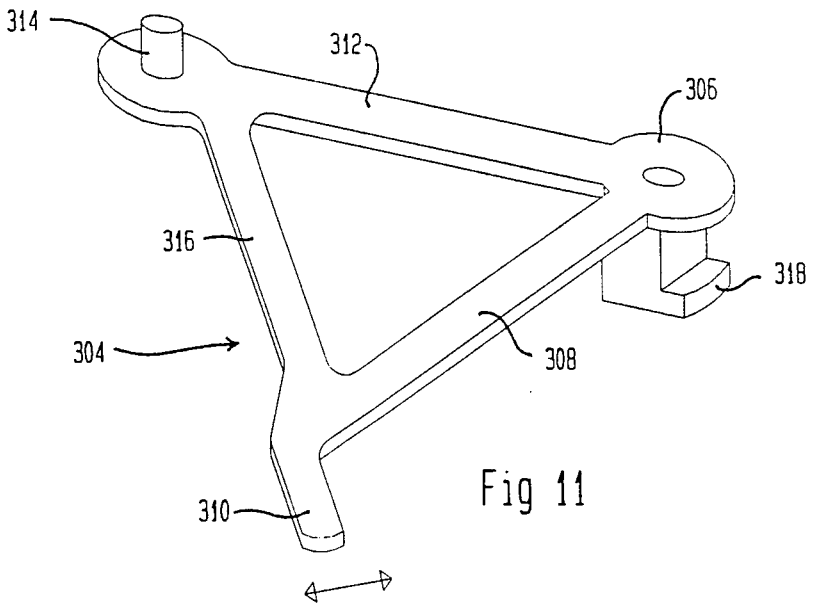
FIG. 11 is a perspective view of a bottom member forming a further part of this batting mechanism.
Figure 12:
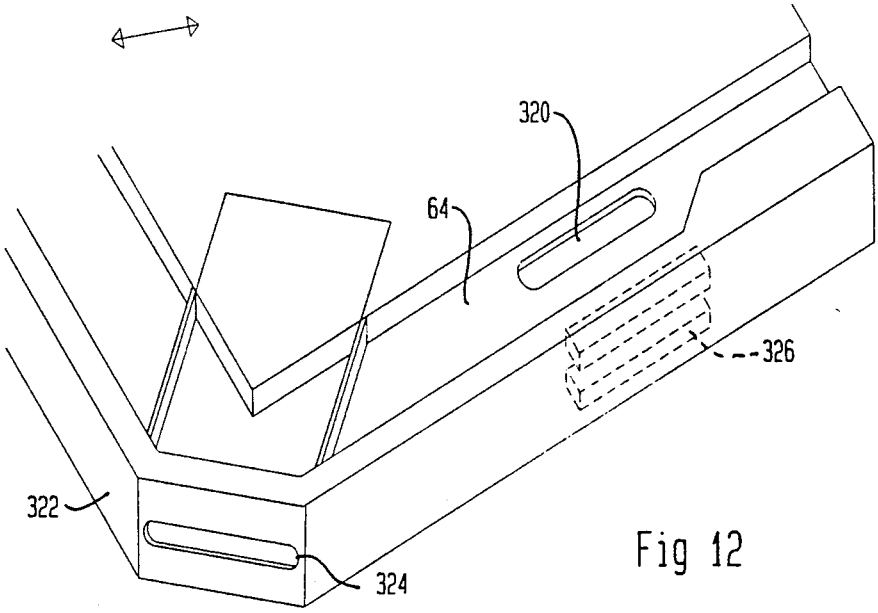
FIG. 12 is a perspective view of the home plate corner of a panel structure constructed for mounting the batting mechanism of FIGS. 10 and 11.

FIG. 9 of the drawings illustrates the top of a third, smaller embodiment of a simulated baseball game apparatus 270. This apparatus has a smaller playing surface 272 which in one embodiment measures about 18" along each side including the edge structure. This smaller playing surface corresponds to the infield of a normal baseball field with the infielders moved in to some extent. There are a first baseman 274, a second baseman 276, a short stop 278 and a third baseman 280. Located adjacent to the home plate 282 is another form of batting device 284, the details of which are illustrated in FIGS. 10 to 12.

Located near the corner of the apparatus diagonally opposite the batting device is a simulated pitching mechanism 286. This mechanism includes very simple means for rolling a ball in the general direction of home plate, which means are illustrated in detail in FIGS. 17 to 19. There are also means for changing the direction of the rolling ball after it leaves the ball rolling mechanism, these means being indicated generally at 288.

The first baseman, second baseman, third baseman and shortstop of the game of FIG. 9 are constructed in essentially the same manner. Each Comprises a flat-bottomed cup device which simply sits on the playing surface at a position selected by the defensive player. Typically these players would be positioned generally in the positions shown in FIG. 9. Each fielding device as illustrated has two diverging arms 410 and 412 extending at a substantial acute angle to each other and adapted to catch a ball. The arms are connected by a bottom panel 414 that rests flat on the playing surface. If desired, the arms 410 and 412 can extend at an angle of 90 degrees or slightly more to one another.

The construction of the batting device 284 will now be described with reference to FIGS. 10 to 14. The batting mechanism includes a top member 290 having an elongate bat portion 291 extending generally parallel to and above the playing surface and a vertically extending stem 292 rigidly connected to one end of the bat portion. The bat portion can be shaped in the manner of a standard bat as shown with a relatively wide barrel at 294, a narrower handle and a knob located immediately above the stem. As in the first described embodiment, it has a ball striking extension 296 that extends downwardly and is positioned to move across home plate.

Figure 13:
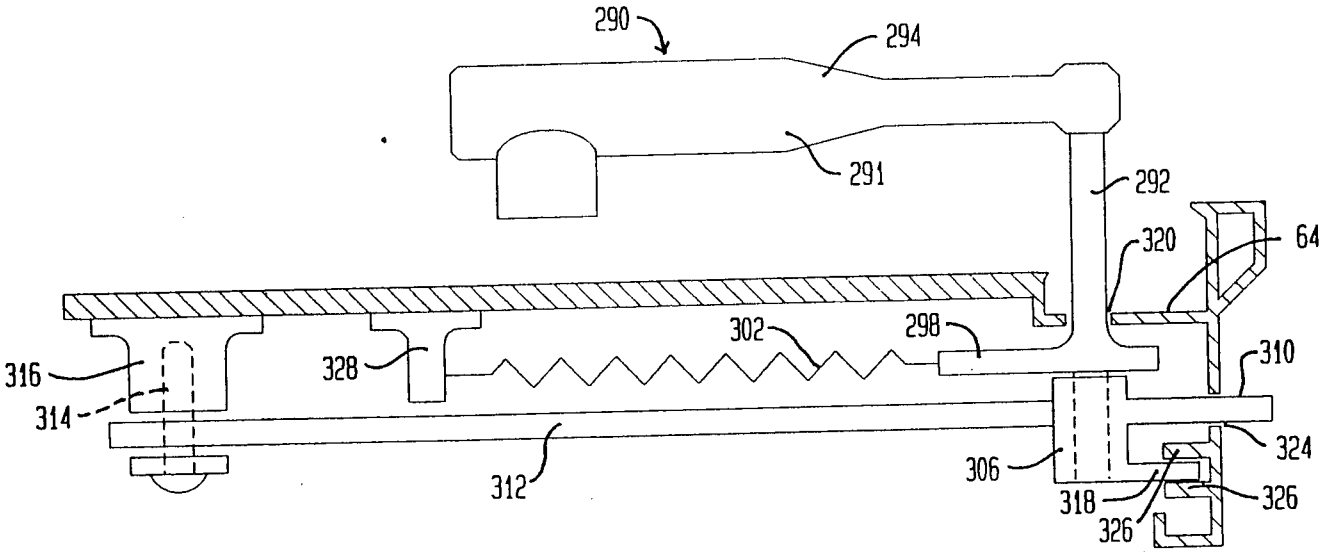
FIG. 13 is a cross-sectional elevation showing the batting mechanism mounted in the panel structure of FIG. 12.

The stem 292 is provided with a fixed collar 298 and a lever arm 300 is an integral part of this collar. As illustrated in FIG. 13, a tension spring 302 is connected to the end of the arm 300 for purposes of pivoting the stem portion and the bat portion.

The batting mechanism includes a bottom member 304 having a socket portion 306 for receiving a bottom end portion 307 of the aforementioned stem. The stem is free to pivot in the socket portion. An arm portion 308 is connected to the socket portion and provides manual means for moving the bottom member in a direction generally parallel to the playing surface of the game. The arm portion 308 is a bent elongate arm that extends generally perpendicular to the stem and has an outer end section 310 that projects from an upright side of the game apparatus as shown in FIG. 13. In the illustrated embodiment, the bottom member has a second arm 312 which extends at an angle to the arm portion 308 and a pivot pin 314 projects upwardly from the end of this arm. This pivot pin fits into a suitable socket member 316 connected to the bottom of the panel that forms the playing surface. The pivot pin 314 helps both to support the bottom member 304 and to guide its movement as explained further hereinafter. If desired, the two arms 308 and 312 can be connected intermediate their ends by a stiffener 316 which is integral with the arms. The bottom end of the socket portion 306 can be formed with an outwardly extending flange 318 which is also used to support and guide the bottom member.

FIGS. 12 and 13 illustrate the corner of the board wherein the batting mechanism of FIGS. 10 and 11 is mounted. Formed in the ball pocket 64 is a slot 320 which can be straight or slightly curved. This slot is sufficiently wide to permit free movement of the stem 292 in the slot. The aforementioned collar 298 is positioned below this slot. In the vertically extending edge structure 322 of the adjacent corner of the board or panel is a further slot 324 through which the aforementioned end section 310 of the arm extends. The slot 324 is generally horizontal or parallel to the playing surface. Formed on the inside of the edge structure 322 are a pair of parallel ribs 326 which form a horizontal track for the aforementioned flange 318. This track helps to keep the pivot axis formed by the socket portion 306 vertical. Also illustrated in FIG. 13 is a downwardly extending pin connector 328 to which one end of the spring 302 is connected. This pin and the spring 302 are so positioned so as to swing the bat portion in a forwardly direction across home plate.

Figure 14:
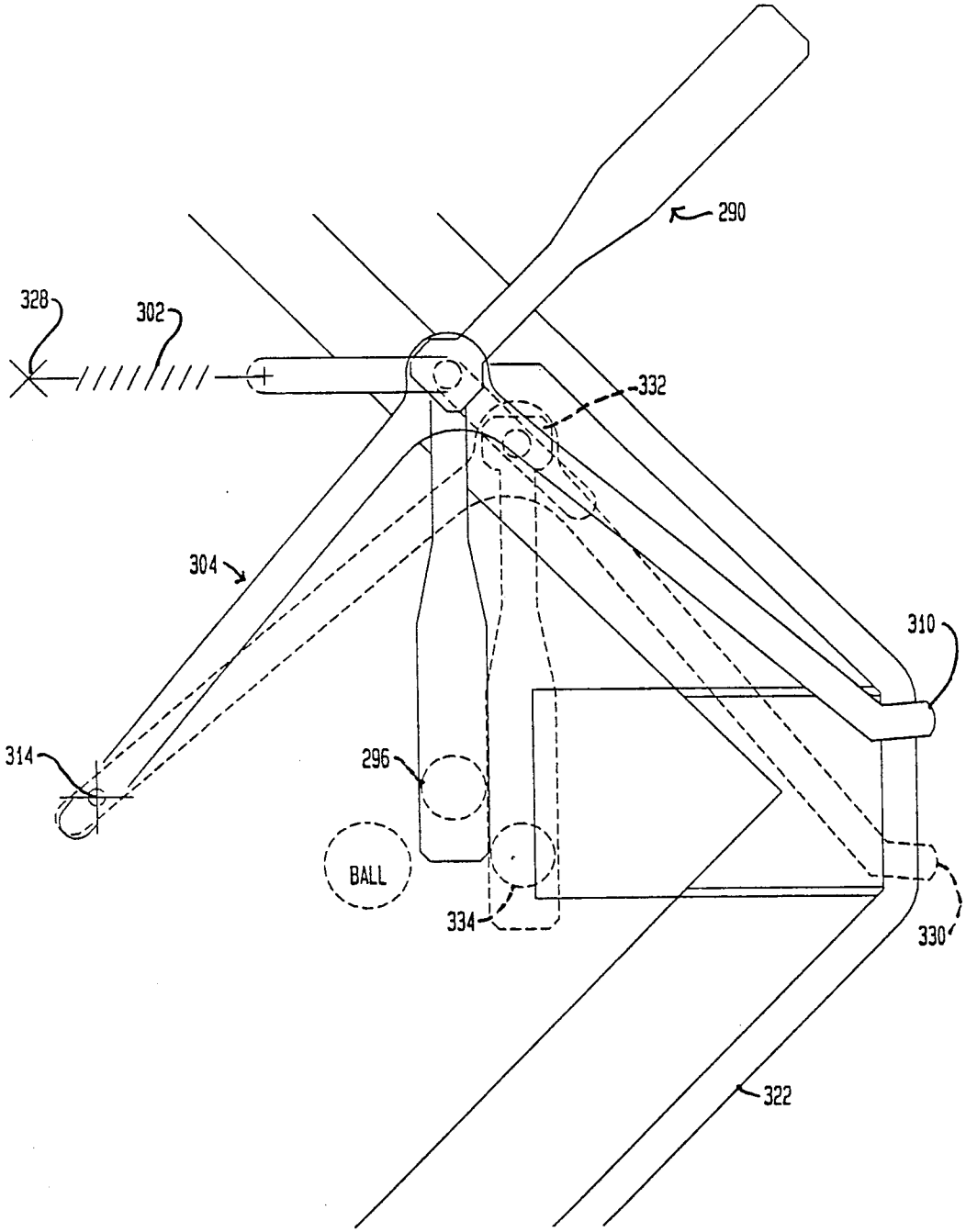
FIG. 14 is a schematic plan view of the home plate corner showing the possible movements of the batting mechanism.

FIG. 14 illustrates the degree of and type of movement that is possible with the batting mechanism of FIGS. 10 to 12. In the solid line position, the bottom member 304 has been pivoted counter-clockwise about the pivot pin 314 so that when the bat portion swings across home plate, its downward extension indicated at 296 is located at about the centre of home plate. This position is ideal for hitting a ball that is coming straight across the centre of the home plate. However if the batter wishes to reach out in order to hit a ball (such as the one illustrated) coming across the outer part of the plate, the bottom member is pivoted clockwise to the position indicated in dashed lines. Thus the end section of the bottom member will be located at 330. This moves the socket portion 306 to the position indicated at 332. As a result the downward extension of the bat portion will swing across the outer portion of the plate as shown at 334. It will be appreciated that with this version of the batting mechanism, the downward extension 296 can be made narrower in the longitudinal direction of the bat in order to make the game more difficult, if desired.

Figure 19:
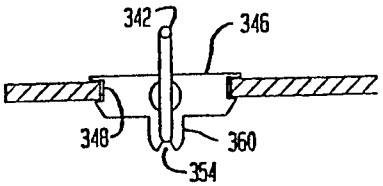
FIG. 19 is a cross-sectional front view of this pitching mechanism.
Figure 18:
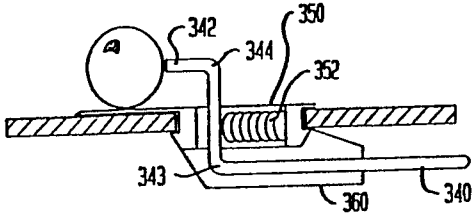
FIG. 18 is a cross-sectional elevation of this pitching mechanism mounted in the panel forming the playing surface.
Figure 17:
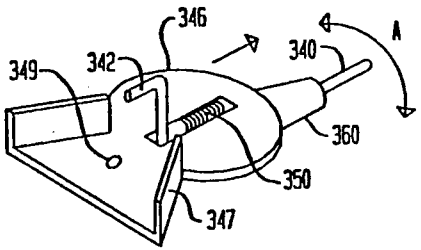
FIG. 17 is a detail view in perspective of a second form of pitching mechanism.

FIGS. 17 to 19 illustrate a very simple mechanism for providing means for rolling the ball in the general direction of home plate from the pitching position. This rolling device includes a movable elongate rod 340 having a ball engaging end 342 positioned above the playing surface. In the illustrated embodiment this rod has two ninety degree bends 343 and 344 to permit the rod to extend along the bottom of the panel that forms the playing surface and then to project upwardly through the playing surface. There are means for holding the ball engaging end of the rod and limiting movement thereof. In this embodiment the holding means comprises part of the means for pivoting the pitching mechanism about a vertical axis in order to provide initial direction to the rolling ball leaving the pitching mechanism. In particular the holding and pivoting mechanism comprises a disk-like member 346 having a round portion mounted for pivoting movement in a circular hole in the playing surface. As illustrated, this member 346 has an annular groove 348 about its perimeter into which the edge of the circular hole fits. The rod 340 extends through a slot 350 formed in the member 346. This slots permits back and forth movement of the rod against the force of biasing spring 352. This spring is positioned in the slot and is held therein. The spring 352 tends to push the bent end of the rod in a direction generally towards home plate. A portion of the rod extends along a track or groove 354 formed along the bottom of the member 346. This track is formed by two downwardly extending, parallel rails 360, each with an inwardly extending lip to hold the rod between the rails. Because of these rails, sideways movement of the end of the rod 340 in the direction of the arrows A of FIG. 17 will pivot the disk-like member 346 in the board.

This simple pitching device is equipped with a clip-on cover 362 which can be similar in size and shape to the fielding devices of the games of FIGS. 3 and 9. The member 346 is designed to hold the ball in a central position for striking by the rod end 342. The preferred form of member 346 is provided with two merging side walls 347 at the front and a small circular depression 349 for properly positioning the ball so that it can be struck with the rod end.

Figure 20:
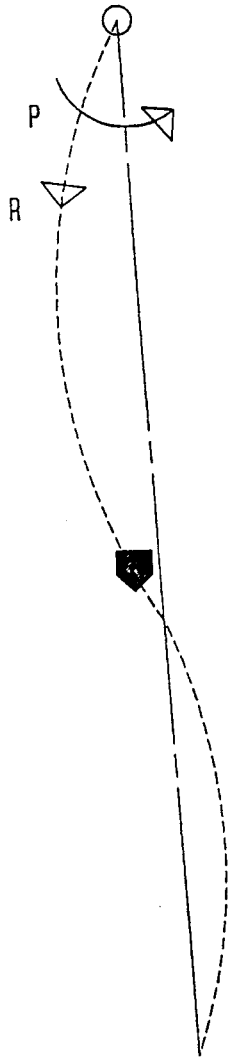
FIG. 20(*a*), 20(*b*), and 20(*c*) illustrate how the present pitching mechanism can "throw" different pitches.
Figure 20:
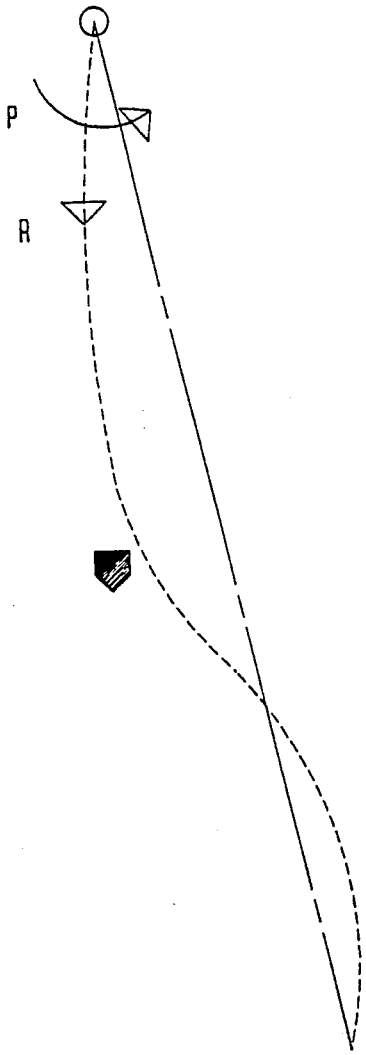
Figure 20:
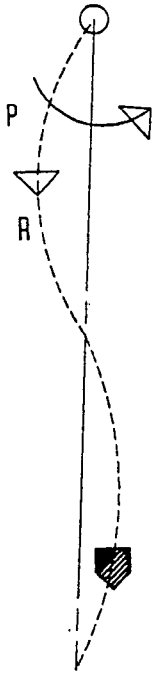

FIG. 20 illustrates how three different types of pitches can be made with the pitching mechanism of the present invention. FIG. 20(*a*) represents the equivalent of a curved ball in baseball, FIG. 20(*b*) represents the equivalent of a "slider", while FIG. 20(*c*) represents the equivalent of a knuckleball pitch. With each of these pitches, essentially a "S" shaped path for the ball is induced. By varying the initial direction of the pitch, the speed of release and the speed of rotation of the circular plate, these three results and others can be achieved. Furthermore these effects can be achieved in both the left and right directions. It will be appreciated that the curve or spin induced in the ball by the rotating circular plate is counteracted by the natural "opposite" spin induced in the ball (the axis of spin is not in the direction of movement). Therefore the arc of the path reduces until it turns "negative", producing the illustrated "S" path.

To further explain the drawings of FIG. 20 the arrows P represent the direction of rotation of the circular plate 110. In FIG. 20(*a*) this plate is rotating slowly, in FIG. 20(*b*) this plate is rotating at medium speed, and in FIG. 20(*c*) this plate is being rotated at a fast rate. The arrow R represents the direction of the rolling ball as it leaves the ball rolling means. In FIG. 20(*a*) the ball is rolled at medium speed, in FIG. 20(*b*) the ball leaves the ball roller at a fast rate and in FIG. 20(*c*), the ball 14 leaves the ball roller at a slow rate of speed.

It will also be appreciated that fast balls can be easily pitched with the pitching mechanism of the invention. In the case of the fast ball, one does not rotate the plate 110, the ball being simply rolled at a fast rate of speed by the ball rolling means. A simulated "change-up" pitch can also be achieved with the pitching mechanism of the invention.

Figure 21:
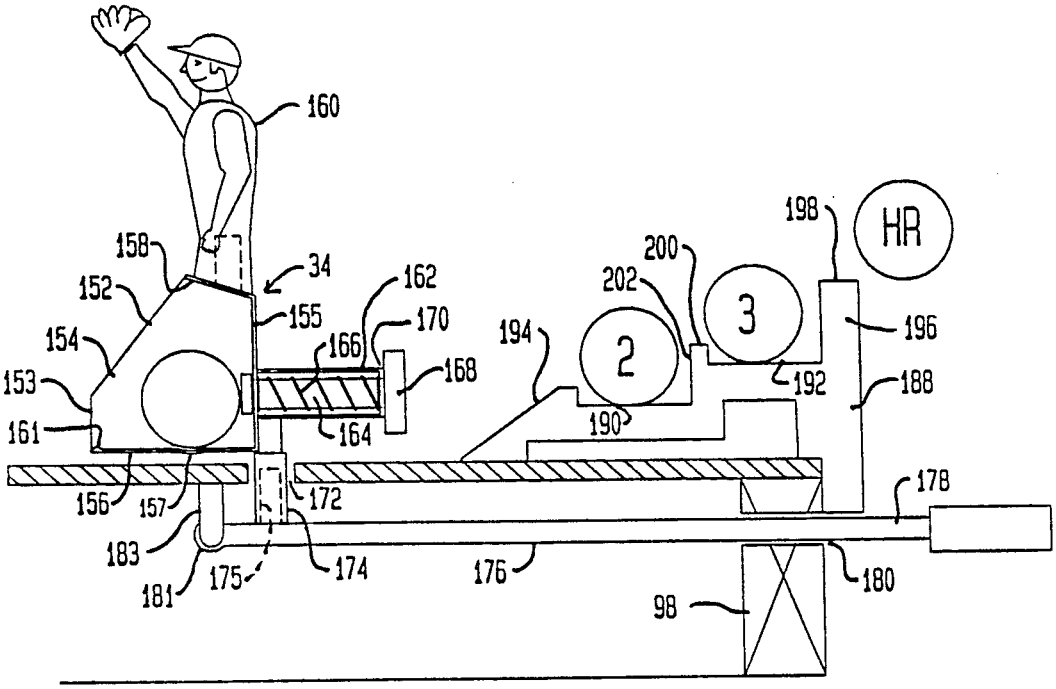
FIG. 21 is a cross-sectional elevation taken along the line XXI—XXI of FIG. 1 illustrating one form of an outfielder device and the edge structure extending along the outer edge of the board.

FIG. 21 illustrates the construction of the fielding device 34 which is one of the three "outfielders". The device 34 has means for catching a ball moving across the playing surface 12 towards the fielding device. This catching means includes a container 152 having an open front 153, two opposing side walls 154, a rear wall 155 extending between the side walls and a bottom 156. In the illustrated preferred embodiment, the container also has an angled top 158 on which is positioned an optional ball player figurine 160. The angled top directs the ball into the catching device and minimizes the chance of the ball bouncing out. It will be appreciated that a ball 14 is caught by positioning the fielding device so that the rolling ball runs into the open front of the container. A small lip 161 can be provided at the front edge of the container to help prevent the ball from rolling out and a small depression 157 in the bottom 156 helps to position the ball in the center of the device. The fielding device also has means for sending a ball caught therein back to a selected location on the playing surface. The illustrated sending means includes a barrel or tube 162 which is rigidly mounted on the rear wall 155 and a shaft 164 slidable therein. A compression spring 166 biases the shaft towards a forwardmost position illustrated in FIG. 21 where a forward end of a shaft projects into the compartment formed by the container 152. There is a knob or handle 168 connected to the outer end of the shaft to enable the shaft to be pulled rearwardly against the spring force. The outer end of the tube 162 has an inwardly extending flange 170 to retain the spring in the barrel.

Figure 24:
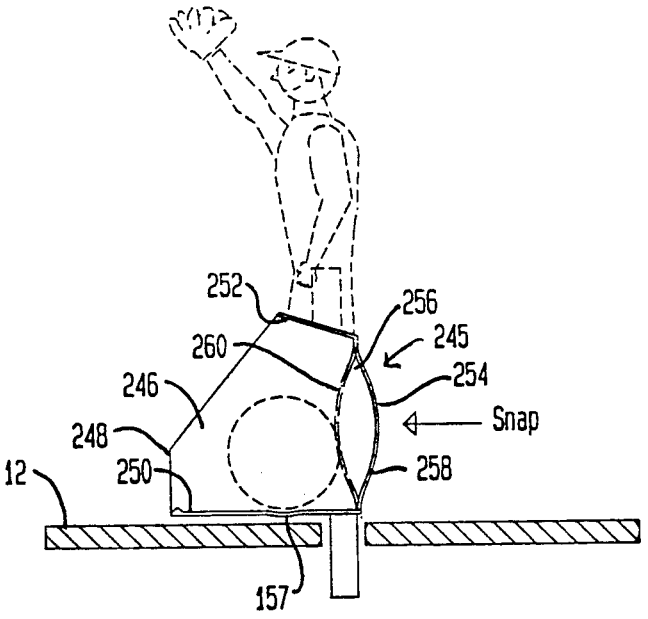
FIG. 24 is a cross-sectional elevation similar to FIG. 21 illustrating an alternate construction for the ball sender in the fielding device.

An alternate form of fielding device 245 is illustrated in FIG. 24 of the drawings. The device 245 has means for catching a ball moving across the playing surface 12 towards the device. The catching means includes a container 246 having an open front, two opposing side walls 248 (only one of which is shown), and a bottom 250. Preferably, the container also has an angled top 252. The fielding device 245 has means for sending a ball caught therein back to a selected location. In this embodiment, the sending means comprises a flexible member 254 extending over an opening 256 in a rear side of the container. The member 254, which preferably is a thin, circular membrane is movable from a rearward position shown in solid lines at 258 to a forward, ball-engaging position shown in dash lines at 260. As illustrated, the member 254 forms a rearwardly facing convex surface in the rearward position 258 and a forwardly facing convex surface in the forward position 260. The member 254, which can be made of plastic having a high elastic modulus, is made so that it will move from the rearward position to the forward position with a quick, snapping action. The snap action occurs as a result of the "snap through" buckling of the membrane. In order to obtain a high snap speed, the member 254 should be made from material having a high elastic modulus. With this high snap speed, the membrane will strike the ball with sufficient force to send it to the desired position. Unlike the ball sender of the embodiment of FIG. 21, the flexible member 254 does not provide any control over the speed of the ball but this is generally not required for purposes of this game. It will be appreciated that a significant advantage of this version of the fielding device is that it can be manufactured at a cost that is substantially less than the version of FIG. 21 requiring a coil spring.

There are means for moving the fielding device 34 a limited distance (approximately 4–7 inches) across the playing surface 12. This moving means includes a slot 172 cut in the board member that constitutes the playing surface. A vertically extending control member, preferably a short tube 174, is connected to the fielding device and is slidable in this slot. It will be understood that the member or tube 174 extends along a vertical axis defined by a vertical bar 175 about which the fielding device can be pivoted manually to control the direction of return of the ball. The bar 175 is connected at its bottom to an elongate, horizontally extending control handle 176 in the form of a flat bar having an outer end 178 that projects from an outer edge portion of the game apparatus. The control handle extends through a slot 180 in the outer side wall 98 of the game board. The other end of the control handle is fitted with a short tube 181 that extends perpendicular to the length of the handle. The tube 181 is free to slide along a horizontal length of rod that is parallel to the slot 172. This rod is connected to the bottom of the game board by upstanding end portions 183. The telescoping engagement between the tube 174 and the bar 175 permits the fielding device to be rotated manually.

The infielders at 36–38 are constructed substantially in the same manner as the fielding device illustrated in FIG. 21 except that there is no control handle 176 and no vertical bar 175. The fielding devices 36–38 are movable respectively in elongate slots 182–184 illustrated in FIG. 1. Extending downwardly through the slot is a pivot pin similar to the member 174 illustrated in FIG. 21. If desired, the bottom of this pivot pin can have a knob to prevent the fielding device from becoming disengaged from its respective slot. Each of the fielding devices 36–38 can be pivoted in its slot manually by grasping the container portion of the device. The fielding devices 36–38 are also equipped with means for sending a ball in a selected direction on the playing surface. The ball sending means 186 is constructed in the same manner as the spring operated ball sender 162, 164 illustrated in FIG. 21.

Turning now to the fielding device 39 illustrated in FIGS. 1 and 2, this device is constructed in substantially the same manner as the fielding devices 32–34, one of which is illustrated in FIG. 21. However, because of the location of the device 39, the much longer control handle 40 is used. Again, a player can pivot the fielding device 39 manually about a vertical axis in order to send a ball in a particular direction. The handle 40 projects from the outer edge of the game board as shown.

One form of edge structure 188 for the outer edge of the outfield is illustrated in FIG. 21. Although this edge structure 188 can extend along the entire outer edge of the game board, it will be appreciated that this particular edge structure may extend along only selected portions or parts of the outer edge, if desired. On the other locations on the outer edge there can be a simple wall to prevent the ball from rolling off of the game board. A ball striking this portion of the outer edge can be treated as a single (that is, permitting the runner to advance one base only).

In the edge structure of FIG. 21, there is a first elongate channel 190 that extends parallel to the outer edge and that has an open top. Positioned outwardly from this channel is a second elongate channel 192 which extends parallel to the outer edge and has an open top. Both of these channels are preferably sized to receive a ball when it is hit to the outer edge of the outfield. Extending between the first channel 190 and the flat playing surface is a ramp means 194 which acts to elevate a ball when it reaches the edge structure. The ramp slopes upwardly from the playing surface to the first channel and, as illustrated, is inclined at an angle of less than 45 degrees to the horizontal. It will be appreciated that a ball that lacks sufficient forward momentum will be unable to roll up the ramp and will remain on the playing surface 12. Unless such a ball has been caught by one of the fielding devices, it will be treated as a "single" permitting the batter to go to first base. However, if the ball is hit sufficiently hard, it will be able to roll up the ramp 194 and drop into the first channel 190. Such a hit ball will be treated as a "double" permitting the batter to move to second base on the play. If the ball is hit even harder, the upward movement caused by the ramp will cause the ball to jump over the channel 190 and into the second channel 192. If the ball lands in the channel 192, it will be considered a "triple", permitting the batter to advance to third base on the play. Finally, if the ball is hit so hard that the ramp 194 causes the ball to jump completely over the edge structure, the hit ball will be considered a home run, a play very similar to a home run in the sport of baseball which is the result of the ball being hit over the outfield fence.

In the preferred illustrated edge structure, the second channel 192 is elevated to some extent above the first channel making it more difficult to hit a ball into this channel. The edge structure includes an outer wall 196 defining an outer side of the second channel and having a top 198 that is higher than the top edge 200 of an inner side of the second channel. Again the height of the outer wall 196 increases the difficulty of hitting a home run ball. The second channel 192 is separated from the first channel by an elongate wall 202 having a top located above the ramp 194. The height of the wall 202 necessitates that the ball be hit reasonably hard for it to be elevated by the ramp 194 into the second channel.

Figure 23:
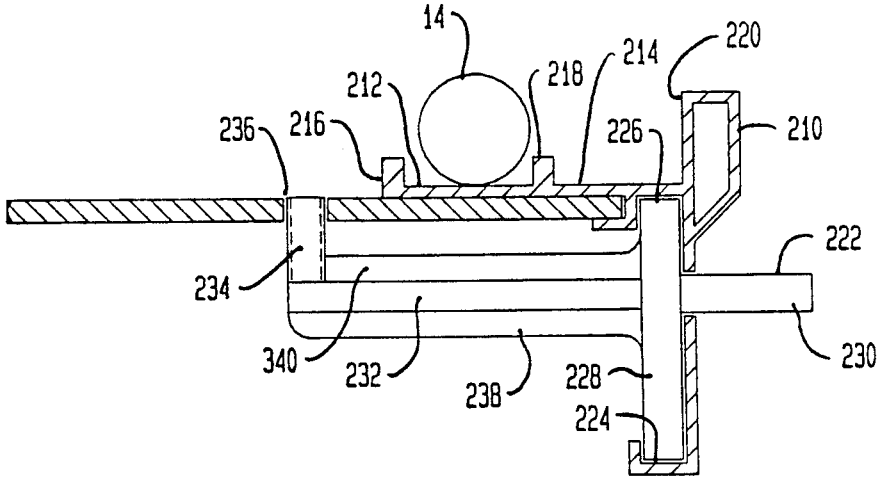
FIG. 23 is a cross-sectional elevation similar to FIG. 21 illustrating an alternate construction for the control of the outfielder device.

An alternate edge structure and control mechanism for a fielding device is illustrated in FIG. 23 of the drawings. This edge structure 210 includes a first elongate channel 212 that extends parallel to the outer edge and that has an open top. Positioned outwardly from this channel is a second elongate channel 214 which also extends parallel to the outer edge and has an open top. Each channel is sized to receive a ball 14 when it is hit to the outer edge of the outfield. Forming the inner side of the channel 212 is a short upstanding wall 216 which has a height slightly less than the radius of the ball 14. It will be understood that if the ball has been hit hard enough, it will strike the wall 216 and bounce or jump over the wall into the channel 212, thus constituting a "double". If the ball is hit even harder, it may jump into the second channel 214, in which case it is considered a "triple". The two channels are separated by middle wall 218 which has a top at approximately the same height as the top of the wall 216. Defining the outer side of the second channel is outer wall 220 which may be hollow, as shown, to reduce the plastic required.

An alternate means for moving a fielding device is shown in FIG. 23. This control mechanism 222 is slidable in upper and lower channels 224 and 226 formed in the elongate plastic extrusion that forms edge structure 210. Slidable in these channels is an upstanding slide member 228 to which is connected horizontally extending control handle 230 which projects through a slot in the edge structure 210. Extending inwardly from the slide member 228 is a control bar or rod 232 which is connected to the fielding device by means of upstanding tube 234. This tube extends into a slot 236 formed in the playing surface. It will be understood that a pivot pin (not shown) connected to the fielding device extends into the tube 234, thus permitting the fielding device to be pivoted manually about a vertical axis. The bar 232 may be provided with upper and lower reinforcing ribs 240, 238 extending longitudinally thereof, if desired.

Figure 25:
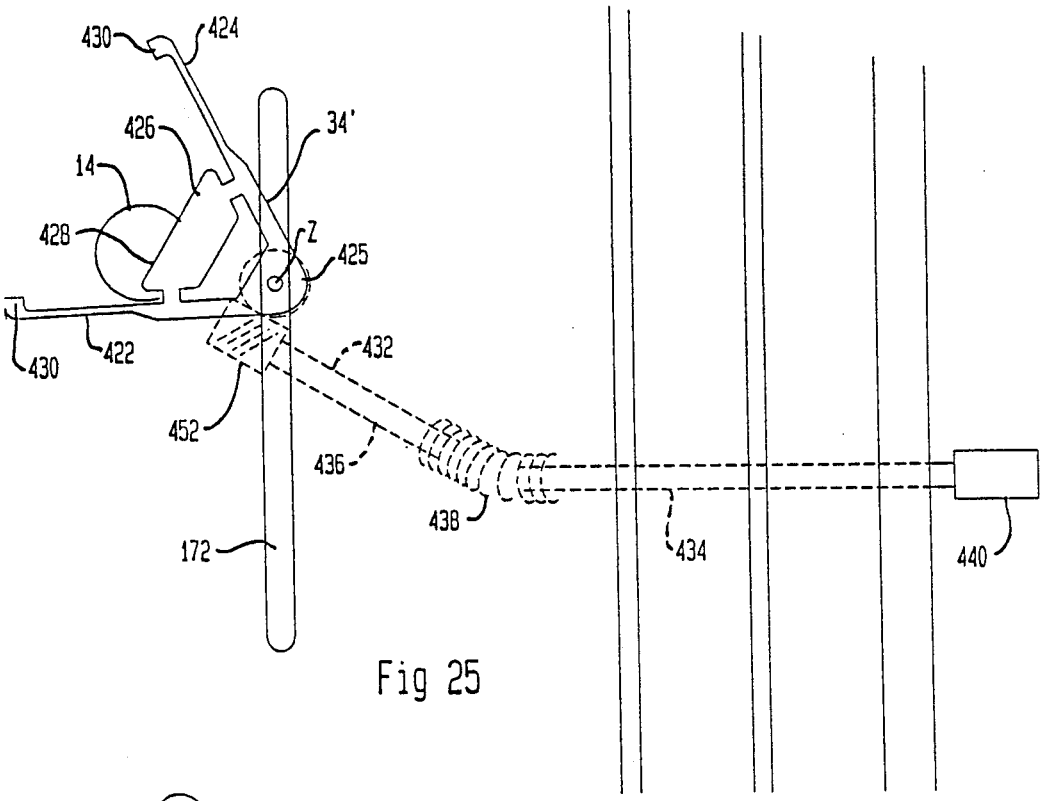
FIG. 25 is a detail top view of an outfielder device used in the embodiment of FIG. 3.
Figure 26:
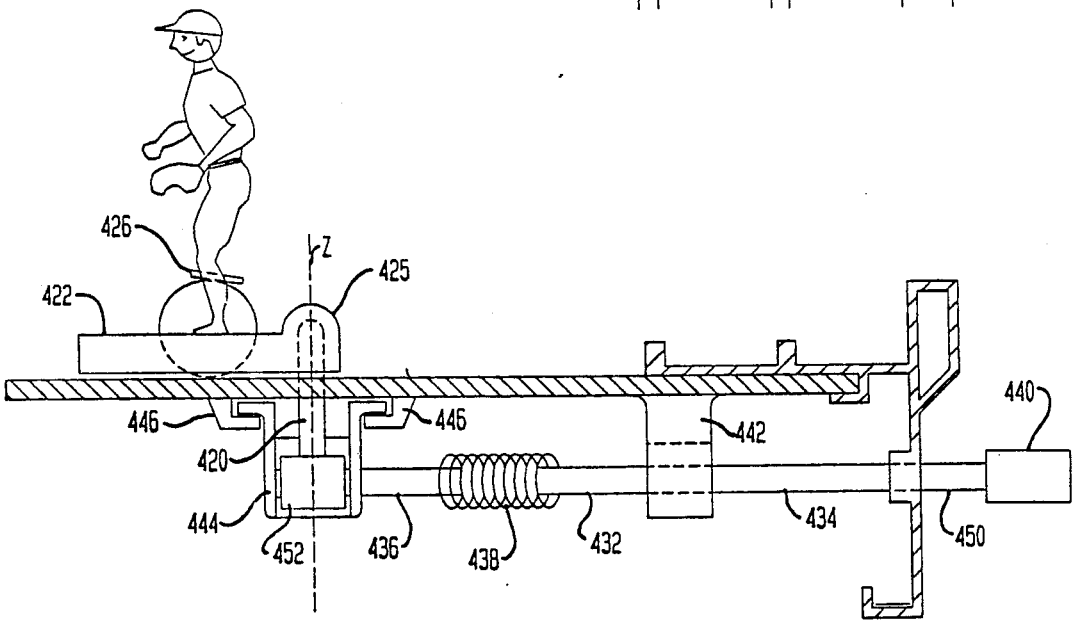
FIG. 26 is a cross-sectional elevation of the outfielder device of FIG. 25 with a player figurine mounted thereon.

One of the outfielder devices of the embodiment of FIGS. 3 and 4 is illustrated in detail in FIGS. 25 and 26.

This outfielder 34' includes means for catching and sending a ball 14 including a pivot member 420 defining a pivot axis indicated at Z extending substantially perpendicular to the playing surface. This pivot member extends through an elongate slot 172 formed in the playing surface. The catching and sending mechanism also includes two outwardly diverging, elongate arms 422 and 424 which extend parallel to the playing surface and which are connected to the pivot member so as to pivot about the pivot axis Z. As illustrated, these arms extend at a substantial acute angle to one another and they meet at corner section 425 which forms a vertically extending hole for receiving the upper end of the pivot member 420. The arms are fixedly connected to the pivot member so as to pivot therewith. If desired, the arms 422 and 424 can extend at an angle of 90 degrees or slightly more to one another. Preferably there is also an upper, ball restraining panel 426 extending between the arms, and as illustrated, located above the top edges of the arms. At least a front edge 428 of this panel is spaced above the playing surface a distance equal to or greater than the diameter of the ball so that the ball will tend to roll under this panel in the illustrated manner. Because the two arms can be pivoted as desired, they can be used to send or fling the ball 14 to a selected location on the playing surface. In order to assist this operation, preferably each of these arms is formed with a lip 430 on its outer end, this lip projection generally in the direction of the other arm. The lip helps to prevent the ball rolling off the outer end of the end of the arm a it is being pivoted. It will be further noted that the arms are somewhat flexible or elastomeric in order to assist the "throwing" operation. The particular arm used to send the ball depends upon the direction in which the ball is to be sent.

There are also means for moving and pivoting the pivot member 420 and the arms so that they can be moved a limited distance across the playing surface and pivoted. The moving and pivoting means includes the aforementioned slot 172 and an elongate, horizontally extending control rod mechanism 432. The preferred control mechanism includes two separate control rod sections 434 and 436 which are connected together by a flexible spring connector 438. It will thus be appreciated that rotation of the rod section 434 about its longitudinal axis by means of a control knob 440 will cause a corresponding rotation of the rod section 436. The rod section 434 is rotatably supported by means of downwardly extending bracket 442. The outer end section of rod section 436 is rotatably supported by a movable bracket 444 mounted to slide along track members 446. The control rod mechanism has an outer end portion 450 that projects from an outer edge of the apparatus and an inner end portion operatively engaging the pivot member 420. In particular the inner end portion has a first gear 452 mounted thereon and located immediately adjacent the pivot member. A second gear (not shown but similar to the gear 88 shown in FIG. 16) is mounted on the bottom end of the pivot member and is rotated by the first gear 452. It will thus be seen that a very efficient and inexpensive fielding device is provided with this construction. This fielding device is capable of both catching a ball over the limited distance that it can move and then sending or rolling the ball to a desired location on the board in order to complete a play.

Preferably, the larger game board shown in FIGS. 1 to 4 measures approximately 36 to 39 inches along each foul line, that is, along the two edges that extend from the home plate corner. This is an ideal board size as it is large enough to allow all of the controls to be effective, yet small enough so that the game can be comfortably played and transported. The playing surface 12 should be covered or painted so that it has a high friction level for good ball action. A well known rubberized coating material can be used for this purpose or a suitable felt material. The areas of the playing surface which correspond to the grass areas of a normal baseball field can be colored green while the smaller areas, that are dirt areas on a baseball field, including the warning track along the outfield and the circular plate, can be colored brown on the present game board.

The fielder figurines on top of the fielding devices can be plastic men about 2 ½ inches high. The container that is part of each fielding device typically measures 1 ½ inches wide. The complete game is also equipped with runners in the form of plastic ball players with no moving parts. Preferably, each runner is provided with a peg at the bottom of one leg which can be plugged into a hole 204 located in the center of each base. If desired they can also be plugged into an "out" box to keep track of retired batters in each inning. A simulated baseball game can be played with the above described apparatus by 2–6 players at one time. Teams can also play with perhaps three on each team being the preferred number of players.

The rules for the simulated baseball game are essentially the same as those for field baseball resulting in a game with great similarity to the sport. The present simulated baseball game has the following plays:

| | |
|---|---|
| Balls | A pitched ball which falls into one of the two "Ball" pockets. |
| Strikes-swung | Batter swings and misses. |
| Strikes-called | Ball falls into the Strike pocket. |
| Ground ball | Batted ball which is not "caught" directly but can be reached by a fielder and is then thrown and caught by a baseman who is touching a base. A time limit may be placed on this if desired. |
| Fly balls | Ball caught in fielders "cup" directly. |
| Steals | Runner elects to steal and pitcher fails to "throw" ball to baseman's "cup". |
| Double play | A ground ball or fly ball caught by an infielder which is relayed to the relevant baseman who is touching the base during the play. (Infield fly rule does not apply). |
| Single | A batted ball which does not touch a fielder and comes to rest either in the outfield or on the dirt of the infield. |
| Double | A batted ball which ends up in the lower groove of the warning track. |
| Triple | A batted ball which ends up in the upper groove of the warning track. |
| Home run | A batted ball which falls from the table over the warning track and fence. |
| Foul tip | A batted ball which ends up in the foul gutter or pockets behind the batter. |
| Wild pitch | A pitch which misses the Strike and Ball pocket. |
| Batted balls | The result of a batted ball is essentially based upon where the ball comes to rest. Examples: If the ball hits a fielder and then is caught by a second fielder the batter is out (fly ball). If the ball hits a fielder and then goes for a double, triple or home run the score stands. The exception to this rule is when the ball goes over the foul line fence after hitting a fielder. This is a ground rule double. |
| Pitched balls | Pitched balls which are not swung at are judged on their first location. Once the ball hits the ball pocket, the strike pocket or the foul gutter the ball is dead. Occasionally, a wild pitch can bounce into the strike pocket or a strike can bounce out of the pocket. The latter movement is ignored. |

The game board that forms the playing surface can be made of thin plastic or hardboard sheet. The board is stiffened at the edges by plastic extrusions which also form the edge structure along the outer edge of the outfield. Although the edge structure forming the "outfield fence" is shown as segmented in FIGS. 1 to 4, it could easily be curved instead. Elongate plastic extrusions can also be used at intermediate points for stiffening purposes. A section made by injection can be used to construct the home plate area, providing the described pockets for the balls and strikes and housing the two batting mechanisms. The game board shown in FIG. 9 can be made from a single plastic injection molding. A game board constructed in this manner can be manufactured at a reasonable cost. Most of the described components for the game can be made of plastic. The ball can be a plain metal ball or one that has a rubber finish.

It Will be appreciated by those skilled in the construction of game devices that various modifications and changes can be made to the described apparatus without departing from the spirit and scope of this invention. Accordingly, all such modifications and changes as fall within the scope of the appended claims are intended to be part of this invention.

We therefore claim:

1. In a simulated baseball game apparatus having an upwardly facing playing surface and a home plate on said surface, a simulated pitching mechanism comprising means for rolling a ball in the general direction of home plate and manually operated means for changing the direction of the rolling ball after it leaves said rolling means, said direction changing means including a variable speed rotatable plate having a generally flat upper surface located in the plane of said playing surface and adjacent said rolling means, wherein said direction changing means is separate from said rolling means and at least a portion of said rotatable plate extends forwardly from a release point for said rolling means in the direction of the home plate.

2. A game apparatus according to claim 1 wherein said pitching mechanism including means for pivoting said rolling means about a vertical axis in order that a player of the game can control the initial direction of the rolling ball.

3. A game apparatus according to claim 2 wherein said rolling means includes a movable elongate rod having a ball engaging end positioned above said playing surface, spring means for biasing said rod to move in a direction towards home plate, and means for holding said ball engaging end and limiting movement thereof.

4. A game apparatus according to claim 1 wherein said direction changing means includes manually operated means for rotating said plate operable from a location at one edge of the playing surface of the apparatus.

5. A game apparatus according to claim 1 wherein said rolling means is an electrically operated release mechanism comprising an electromagnetic activator and means for controlling the speed of the rolling ball.

6. In a simulated baseball game apparatus having a generally flat, upwardly facing playing surface and a home plate, a batting mechanism mounted in said apparatus adjacent said home plate, said mechanism including a top member having an elongate bat portion extending generally parallel to and above said playing surface and a vertically extending stem rigidly connected to one end of said bat portion, and a bottom member having means for pivotally mounting a lower portion of said stem so that said stem is free to pivot about a substantially vertical axis for swinging said bat portion to hit a ball, said bottom member including an arm portion providing manual means for moving said bottom member in a direction generally parallel to said playing surface for varying the extension of said bat portion above said playing surface.

7. A game apparatus according to claim 6 wherein said arm portion is an elongate arm that extends generally perpendicular to said stem and has an outer end section projecting from an upright side of the game apparatus.

8. A game apparatus according to claim 6 including a panel having an upper surface forming said playing surface and having a vertically extending edge structure extending along edges of said panel, said edge structure having a slot formed therein and extending parallel to said playing surface, wherein said arm portion extends generally perpendicular to said stem and has an end section projecting outwardly through said slot and movable therein.

9. A game apparatus according to claim 8 wherein said panel includes means for guiding the movement of said bottom member by said arm portion.

10. A game apparatus according to claim 8 wherein said panel has a second slot formed in its upper surface in the vicinity of home plate and said stem extends through said second slot and is movable along said slot by said arm portion.

11. A game apparatus according to claim 6 including spring means connected to said stem for pivoting said stem and said bat portion in order to hit a ball rolling across said playing surface.

12. In a simulated baseball game apparatus having a generally flat, upwardly facing playing surface and a home plate, a batting mechanism movably mounted in said apparatus adjacent said home plate, said mechanism including an elongate bat portion having a ball-striking end portion and an opposite end portion and being located above said playing surface; a vertically extending stem portion connected to said opposite end portion and capable of pivoting with said bat portion about a generally vertical axis for swinging said bat portion to hit a ball; and a bottom member for pivotally supporting said stem portion, said bottom member including means for manipulating same in order to move said bottom member, said stem portion and said bat portion in a direction generally parallel to said playing surface for varying the extension of said bat portion above said playing surface.

13. A game apparatus according to claim 12 including spring means connected to said stem portion for pivoting said stem portion and said bat portion in order to hit a ball rolling across said playing surface.

14. A game apparatus according to claim 13 wherein said bottom member is pivotally connected at one end to a panel forming said playing surface and said manipulating means is an elongate arm that extends generally perpendicular to said stem portion and has an outer end section projecting from an upright side of the apparatus.

15. A game apparatus according to claim 13 including a panel having an upper surface forming said playing surface and having a vertically extending edge structure extending along edges of said panel, said edge structure having a slot formed therein and extending parallel to said playing surface, wherein said manipulating means includes an elongate arm that extends generally perpendicular to said stem portion and has an outer end section projecting through said slot and movable therein.

16. In a simulated baseball game apparatus having an upwardly facing playing surface and a home plate on said surface, a simulated pitching mechanism for rolling a ball in the general direction of home plate, means for pivoting said pitching mechanism about a vertical axis in order to provide initial direction to the rolling ball leaving said pitching mechanism, and means for changing the direction of the rolling ball after it leaves said pitching mechanism, said direction changing means including a rotatable plate having a generally flat upper surface located in the plane of said playing surface and manual means for rotating said plate, said rotating means permitting said plate to be rotated at different speeds by a player, wherein at least a substantial portion of said rotatable plate is arranged in front of and close to said pitching mechanism in the direction of the home plate.

17. A game apparatus according to claim 16 wherein said pitching mechanism includes a movable elongate rod having a ball engaging end positioned above said playing surface, spring means for biasing said rod to move in a direction generally towards home plate, and means for holding said ball engaging end and limiting movement thereof.

18. A game apparatus according to claim 16 wherein said pivoting means comprises a disk-like member having a round portion mounted for pivoting movement in a circular hole in the playing surface, said pitching mechanism being supported by said disk-like member.

19. A game apparatus according to claim 18 wherein said pitching mechanism includes a movable elongate rod having a ball engaging end positioned above said playing surface, said rod extending through a slot in said disk-like member and slidably held by said disk-like member whereby sideways movement of one end of said rod will pivot said disk-like member about said vertical axis.

20. A game apparatus according to claim 16 wherein said direction changing means includes elongate rod means for rotating said plate manually from a location at one edge of the playing surface.

21. In a simulated baseball game apparatus having a playing surface, a fielding device movable mounted on said playing surface, said device including means for catching and sending a ball comprising a pivot member defining a pivot axis extending substantially perpendicular to said playing surface and two, outwardly diverging, elongate arms extending parallel to said playing surface and connected to said pivot member so as to pivot about said pivot axis, and means for moving and pivoting said pivot member and said arms whereby they can be moved a limited distance across the playing surface and pivoted so that a selected one of the arms sends the ball to a selected location on the playing surface.

22. A game apparatus according to claim 21 wherein said moving and pivoting means includes a slot formed in said playing surface and said pivot member is slidable in said slot.

23. A game apparatus according to claim 22 wherein said moving and pivoting means includes an elongate, horizontally extending control rod mechanism having an outer end portion projecting from an outer edge of the apparatus and an inner end portion with a first gear mounted thereon, said first gear operatively engaging a second gear mounted on said pivot member.

24. A game apparatus according to claim 22 wherein said moving and pivoting means includes an elongate, horizontally extending control rod mechanism having an outer end portion projecting from an outer edge of the apparatus and an inner end portion operatively engaging said pivot member.

25. A game apparatus according to claim 24 wherein said means for catching and sending a ball includes an upper, ball-restraining panel extending between said arms, at least a front edge of said panel being spaced above said playing surface a distance equal to or greater than the diameter of said ball.

26. A game apparatus according to claim 21 wherein each arm is formed with a lip on its outer end, said lip projecting generally in the direction of the other arm.

* * * * *